US007797153B2

(12) United States Patent
Hiroe

(10) Patent No.: US 7,797,153 B2
(45) Date of Patent: Sep. 14, 2010

(54) SPEECH SIGNAL SEPARATION APPARATUS AND METHOD

(75) Inventor: Atsuo Hiroe, Kanagawa (JP)

(73) Assignee: Sony Corporation, Tokyo (JP)

( * ) Notice: Subject to any disclaimer, the term of this patent is extended or adjusted under 35 U.S.C. 154(b) by 908 days.

(21) Appl. No.: 11/653,235

(22) Filed: Jan. 16, 2007

(65) Prior Publication Data

US 2007/0185705 A1 Aug. 9, 2007

(30) Foreign Application Priority Data

Jan. 18, 2006 (JP) ..... 2006-010277

(51) Int. Cl.
*G10L 19/14* (2006.01)

(52) U.S. Cl. ..... 704/211; 704/200; 704/205

(58) Field of Classification Search ..... 704/211, 704/200, 204, 205, 216, 217; 455/561; 370/203
See application file for complete search history.

(56) References Cited

U.S. PATENT DOCUMENTS 5,959,966 A * 9/1999 Torkkola ..... 370/203
7,047,043 B2 * 5/2006 Reilly et al. ..... 455/561

FOREIGN PATENT DOCUMENTS

JP 2004-145172 5/2004
JP 2004-302122 10/2004
JP 2005-91732 4/2005
JP 2006-238409 9/2006
WO WO 2005/029463 3/2005

OTHER PUBLICATIONS

Atsuo Hiroe.; "Solution of Permutation Problem in Frequency Domain ICA, Using Multivariate Probability Density Functions" Independent Component Analysis and Blind Signal Separation Lecture Notes in Computer Science; vol. 3889, 2006, pp. 601-608, XP019028869.

Ciaramella A et al.; "Amplitude and Permutation Indeterminacies in Frequency Domain Convolved ICA"; IJCNN 2003 Proceedings of the International Joint Conference on Neural Networks 2003; Portland, OR; Jul. 20-24, 2003; International Joint Conference on Neural Networks; New York, NY; IEEE; US; vol. 4 of 4; Jul. 20, 2003; pp. 708-713; XP010652512.

Nikolaos Mitianoudis and Michael E. Davies; "Audio source separation of convolution mixtures" IEEE Transactions on Speech and Audio Processing, IEEE Service Center, New York, NY, vol. 11, No. 5, Sep. 2003, pp. 489-497, XP011100008.

(Continued)

*Primary Examiner*—Huyen X. Vo
(74) *Attorney, Agent, or Firm*—Finnegan, Henderson, Farabow, Garrett & Dunner, L.L.P.

(57) ABSTRACT

A speech signal separation apparatus for separating an observation signal in a time domain of a plurality of channels wherein a plurality of signals having a speech signal are mixed using independent component analysis to produce a plurality of separation signals of the different channels, including: a first conversion section, a non-correlating section, a separation section, and a second conversion section.

4 Claims, 12 Drawing Sheets

OTHER PUBLICATIONS

Futoshi Asano et al.; "Combined Approach of Array Processing and Independent Component Analysis and Independent Component Analysis for Blind Separation of Acoustic Signals"; IEEE Transactions on Speech and Audio Processing, IEEE Service Center, New York, NY; vol. 11; No. 3; May 2003; pp. 204-215; XP011079702.

H. Sawada et al., "Blind Separation of More than Two Sources in a Real Room Environment", Acoustical Society of Japan 2003 Autumn Meeting, pp. 547-548, 2003.

Noboru Murata et al., "An On-line Algorithm for Blind Source Separation on Speech Signals.", In Proceedings of 1998 International Symposium on Nonlinear Theory and its Applications (NOLTA '98), pp. 923-926, Crans-Montana, Switzerland, Sep. 1998.

Noboru Murata, "Introduction of Independent Component Analysis", Tokyo Denki University Press, ISBN4-501-53750-7, 2004.

Sawada H et al.; "A Robust and Precise Method for Solving the Permutation Problem of Frequency-Domain Blind Source Separation"; IEEE Transactions on Speech and Audio Processing; IEEE Service Center; New York, NY; vol. 12; No. 5; Sep. 2004; pp. 530-538; XP003001158.

K. Matsuoka et al., "Minimal Distortion Principle for Blind Source Separation.", SICE 2002 pp. 2138-2143, Aug. 5-7, 2002, Osaka.

Noboru Murata, "Introduction of Independent Component Analysis", Tokyo Denki University Press, ISBN4-501-53750-7, pp. 124-203 2004.

Y. Sakaguchi et al., "Feature Extraction Using Supervised Independent Component Analysis by Maximizing Class Distance," IEEJ Trans. EIS, vol. 124, No. 1, pp. 157-163 (2004).

"Notification of Reasons for Refusal" in Japanese Application No. 2006-010277 filed Jan. 18, 2006 (Drafting date: Dec. 22, 2009).

* cited by examiner

SPEECH SIGNAL SEPARATION APPARATUS AND METHOD

CROSS REFERENCES TO RELATED APPLICATIONS

The present invention contains subject matter related to Japanese Patent Application JP 2006-010277, filed in the Japanese Patent Office on Jan. 18, 2006, the entire contents of which being incorporated herein by reference.

BACKGROUND OF THE INVENTION

1. Field of the Invention

This invention relates to a speech signal separation apparatus and method for separating a speech signal with which a plurality of signals are mixed are separated into the signals using independent component analysis (ICA).

2. Description of the Related Art

A technique of independent component analysis (ICA) of separating and reconstructing a plurality of original signals using only statistic independency from a signal in which the original signals are mixed linearly with unknown coefficients attracts notice in the field of signal processing. By applying the independent component analysis, a speech signal can be separated and reconstructed even in such a situation that, for example, a speaker and a microphone are located at places spaced from away from each other and the microphone picks up sound other than the speech of the speaker.

Here, it is investigated to separate a speech signal with which a plurality of signals are mixed into the individual signals using the independent component analysis in the time-frequency domain.

It is assumed that, as seen in FIG. 7, different sounds are emitted individually from N sound sources and are observed using n microphones. Sound (original signal) emitted from a sound source is subject to time delay, reflection and so forth before it reaches a microphone. Therefore, the signal (observation signal) $x_k(t)$ observed by the kth ($1 \leqq k \leqq n$) microphone k is represented by an expression of summation of results of convolution arithmetic operation of an original signal and a transfer function for all sound sources as represented by the expression (1) given below. Further, where the observation signals of all microphones are represented by a single expression, it is given as the expression (2) specified as below. In the expressions (1) and (2), x(t) and s(t) are column vectors which include $x_k(t)$ and $s_k(t)$ as elements thereof, respectively, and A represents an n×N matrix which includes elements $a_{ij}(t)$. It is to be noted that, in the following description, it is assumed that N=n.

$$x_t(t) = \sum_{j=1}^{\mu} \sum_{i=0}^{\infty} a_{tf}(\tau) s_f(t-\tau) = \sum_{j=1}^{N} \{a_{tf} * \varepsilon_t(t)\} \tag{1}$$

-continued $$x(t) = A * s(t) \tag{2}$$

where $$s(t) = \begin{bmatrix} s_1(t) \\ \vdots \\ s_N(t) \end{bmatrix}$$

$$x(t) = \begin{bmatrix} x_1(t) \\ \vdots \\ x_n(t) \end{bmatrix}$$

$$A(t) = \begin{bmatrix} a_{11}(t) & \cdots & a_{1N}(t) \\ \vdots & \iddots & \vdots \\ a_{n1}(t) & \cdots & a_{nN}(t) \end{bmatrix}$$

In the independent component analysis in the time-frequency domain, not A and s(t) are estimated from x(t) of the expression (2) given above, but x(t) is converted into a signal in a time-frequency domain, and signals corresponding to A and s(t) are estimated from the signal in the time-frequency domain. In the following, a method of the estimation is described.

Where results of short-time Fourier transform of the signal vectors x(t) and s(t) through a window of the length L are presented by X(ω, t) and S(ω, t), respectively, and results of similar short-time Fourier transform of the matrix A(t) are represented by A(ω), the expression (2) in the time domain can be represented as the expression (3) in the time-frequency domain given below. It is to be noted that ω represents the number of frequency bins ($1 \leqq \omega \leqq M$), and t represents the frame number ($1 \leqq t \leqq T$). In the independent component analysis in the time-frequency domain, S(ω, t) and A(ω) are estimated in the time-frequency domain.

$$X(\omega, t) = A(\omega) S(\omega, t) \tag{3}$$

where $$X(\omega, t) = \begin{bmatrix} X_1(\omega, t) \\ \vdots \\ X_n(\omega, t) \end{bmatrix}$$

$$S(\omega, t) = \begin{bmatrix} S_1(\omega, t) \\ \vdots \\ S_n(\omega, t) \end{bmatrix}$$

It is to be noted that the number of frequency bins originally is equal to the length L of the window, and the frequency bins individually represent frequency components where the range from −R/2 to R/2 is divided into L portions. Here, R is the sampling frequency. It is to be noted that a negative frequency component is a c conjugate complex number of a positive frequency component and can be represented by X(−ω)=conj(X(ω)) (conj(•) is a conjugate complex number). Therefore, in the present specification, only non-negative frequency components from 0 to R/2 (the number of frequency bins is L/2+1) are taken into consideration, and the numbers from 1 to M (M=L/2+1) are applied to the frequency components.

In order to estimate S(ω, t) and A(ω) in the time-frequency domain, for example, such an expression as the expression (4) given below is considered. In the expression (4), Y(ω, t) represents a column vector which includes results $Y_k(\omega, t)$ of short-time Fourier transform of $y_k(t)$ through a window of the length L, and $W(\omega)$ represents an n×n matrix (separation matrix) whose elements are $w_{ij}(\omega)$.

$$Y(\omega, t) = W(\omega)X(\omega, t) \tag{4}$$

where $$Y(\omega, t) = \begin{bmatrix} Y_1(\omega, t) \\ \vdots \\ Y_n(\omega, t) \end{bmatrix}$$

$$W(\omega) = \begin{bmatrix} w_{11}(\omega) & \cdots & w_{1n}(\omega) \\ \vdots & \ddots & \vdots \\ w_{n1}(\omega) & \cdots & w_{nn}(\omega) \end{bmatrix}$$

Then, $W(\omega)$ is determined with which $Y_1(\omega, t)$ to $Y_n(\omega, t)$ become statistically independent of each other (actually the independency is maximum) when t is varied while ω is fixed. As hereinafter described, since the independent component analysis in the time-frequency domain exhibits instability in permutation, a solution exists in addition to $W(\omega)=A(\omega)^{-1}$. If $Y_1(\omega, t)$ to $Y_n(\omega, t)$ which are statistically independent of each other are obtained for all ω, then the separation signals y(t) in the time domain can be obtained by inverse Fourier transforming them.

An outline of conventional independent component analysis in the time-frequency domain is described with reference to FIG. 8. Original signals which are emitted from n sound sources and are independent of each other are represented by $s_1$ to $s_n$ and a vector which includes the original signals $s_1$ to $s_n$ as elements thereof is represented by s. An observation signal x observed by the microphones is obtained by applying the convolution and mixing arithmetic operation of the expression (2) given hereinabove to the original signal s. An example of the observation signal x where the number n of microphones is two, that is, where the number of channels is two, is illustrated in FIG. 9A. Then, short-time Fourier transform is applied to the observation signal x to obtain a signal X in the time-frequency domain. Where elements of the signal X are represented by $X_k(\omega, t)$, $X_k(\omega, t)$ assume complex number values. A chart which represents the absolute values $|X_k(\omega, t)|$ of $X_k(\omega, t)$ in the form of the intensity of the color is referred to as spectrogram. An example of the spectrogram is shown in FIG. 9B. In FIG. 9B, the axis of abscissa indicates t (frame number) and the axis of ordinate indicates ω (frequency bin number). Then, each frequency bin of the signal X is multiplied by $W(\omega)$ to obtain such separation signals Y as seen in FIG. 9C. Then, the separation signals Y are inverse Fourier transformed to obtain such separation signals y in the time domain as see in FIG. 9D.

It is to be noted that, in the following description, also $Y_k(\omega, t)$ and $X_k(\omega, t)$ themselves which are signals in the independent component analysis are each represented as "spectrogram".

Here, as the scale for representing the independency of a signal in the independent component analysis, a Kullback-Leibler information amount (Hereinafter referred to as "KL information amount"), a kurtosis and so forth are available. However, the KL information amount is used here as an example.

Attention is paid to a certain frequency bin as seen in FIG. 10. Where $Y_k(\omega, t)$ when the frame number t thereof is varied within the range from 1 to T is represented by $Y_k(\omega)$, the KL information amount $I(X_k(\omega)$ which is a scale representative of the independency of the separation signals $X_1(\omega)$ to $Y_n(\omega)$ is defined as represented by the expression (5) given below. In particular, the value obtained when the simultaneous entropy $H(Y_k(\omega))$ for each frequency bin (=ω) for all channels is subtracted from the sum total of the entropy $H(Y_k(\omega))$ for the frequency bins (=ω) for the individual channels is defined as KL information amount $I(Y(\omega))$. A relationship between $H(Y_k(\omega))$ and $H(Y(\omega))$ where n=2 is illustrated in FIG. 11. $H(Y_k(\omega))$ in the expression (5) is re-written into the first term of the expression (6) given below in accordance with the definition of entropy, and $H(Y(\omega))$ is developed into the second and third terms of the expression (6) in accordance with the expression (4). In the expression (A) $P_{Yk(\omega)}(Y_k(\omega, t))$ represents a probabilistic density function (PDF) of $Y_k(\omega, t)$, and $H(X(\omega))$ represents the simultaneous entropy of the observation signal $X(\omega)$.

$$I(Y(\omega)) = \sum_{k=1}^{n} H(Y_k(\omega)) - H(Y(\omega)) \tag{5}$$

$$= \sum_{k=1}^{n} E_k[-\log P_{Y_k(\omega)}(Y_k(\omega, t))] - \log|\det(W(\omega))| - H(X(\omega)) \tag{6}$$

where $$Y_k(\omega) = [Y_k(\omega, 1) \cdots Y_k(\omega, T)]$$

$$Y(\omega) = \begin{bmatrix} Y_1(\omega) \\ \vdots \\ Y_n(\omega) \end{bmatrix}$$

$$X(\omega) = [X(\omega, 1) \cdots X(\omega, T)]$$

Since the KL information amount $I(Y(\omega))$ exhibits a minimum value (ideally zero) where $Y_1(\omega)$ to $Y_n(\omega)$ are independent of each other, the separation process determines a separation matrix $W(\omega)$ with which the KL information amount $I(Y(\omega))$ is minimized.

The most basic algorithm for determining the separation matrix $W(\omega)$ is to update a separation matrix based on a natural gradient method as recognized from the expressions (7) and (8) given below. Details of the deriving process of the expressions (7) and (8) are described in Noboru MURATA, "Introduction to the independent component analysis", Tokyo Denki University Press (hereinafter referred to as Non-Patent Document 1), particularly in "3.3.1 Basic Gradient Method".

$$\Delta W(\omega) = |I_n + E_t|\varphi(Y(\omega, t))Y(\omega, t)^H||W(\omega) \tag{7}$$

$$W(\omega) \leftarrow W(\omega) + \eta \cdot \Delta W(\omega) \tag{8}$$

where $$Y(\omega, t) = W(\omega)X(\omega, t) \tag{9}$$

$$\phi(Y(\omega, t)) = \begin{bmatrix} \phi_1(Y_1(\omega, t)) \\ \vdots \\ \phi_n(Y_n(\omega, t)) \end{bmatrix}$$

$$\phi_k(Y_k(\omega, t)) = \frac{\partial}{\partial Y_k(\omega, t)} \log P_{Yk(\omega)}(Y_k(\omega, t))$$

In the expression (7) above, $I_n$ represents an n×n unit matrix, and $E_t[\bullet]$ represents an average in the frame direction. Further, the superscript "H" represents an Hermitian inversion (a vector is inverted and elements thereof are replaced by a conjugate complex number). Further, the function ϕ is differentiation of a logarithm of a probability density function and is called score function (or "activation function"). Further, η in the expression (6) above represents a learning function which has a very low positive value.

It is to be noted that it is known that the probability density function used in the expression (7) above need not necessarily truly reflect the distribution of $Y_k(\omega, t)$ but may be fixed. Examples of the probability density function are indicated by the following expressions (10) and (12), and the score functions in this instance are indicated by the following expressions (11) and (13), respectively.

$$P_{Yk(\omega)}(Y_k(\omega, t)) = \frac{1}{\cosh(|Y_k(\omega, t)|)} \tag{10}$$

$$\phi_k(Y_k(\omega, t)) = -\tanh(|Y_k(\omega, t)|)\frac{Y_k(\omega, t)}{|Y_k(\omega, t)|} \tag{11}$$

$$P_{Yk(\omega)}(Y_k(\omega, t)) = \exp(-|Y_k(\omega, t)|) \tag{12}$$

$$\phi_k(Y_k(\omega, t)) = -\frac{Y_k(\omega, t)}{|Y_k(\omega, t)|} \tag{13}$$

According to the natural gradient method, a modification value $\Delta W(\omega)$ of the separation matrix $W(\omega)$ in accordance with the expression (7) given hereinabove, and then $W(\omega)$ is updated in accordance with the expression (8) given above, whereafter the updated separation matrix $W(\omega)$ is used to produce a separation signal in accordance with the expression (9). If the loop processes of the expressions (7) to (9) are repeated many times, then the elements of $W(\omega)$ finally converge to certain values, which make estimated values of the separation matrix. Then, a result when a separation process is performed using the separation matrix makes a final separation signal.

However, such a simple natural gradient method as described above has a problem that the number of times of execution of the loop processes until $W(\omega)$ converges is great. Therefore, in order to reduce the number of times of execution of the loop processes, a method has been proposed wherein a pre-process (hereinafter described) called non-correlating is applied to an observation signal, and a separation matrix is searched out from within an orthogonal matrix. The orthogonal matrix is a square matrix which satisfies a condition defined by the expression (14) given below. If the orthogonality restriction (condition for satisfying that, when $W(\omega)$ is an orthogonal matrix, also $W(\omega)+\eta\cdot\Delta W(\omega)$ becomes an orthogonal matrix) is applied to the expression (7) given hereinabove, then the expression (15) given below is obtained. Details of the process of derivation of the expression (15) are disclosed in Non-Patent Document 1, particularly in "3.3.2 Gradient method restricted to an orthogonal matrix".

$$W(\omega)W(\omega)^H = I_n \tag{14}$$

$$\Delta W(\omega) = E_t[\phi(Y(\omega, t))Y(\omega, t)^H - Y(\omega, t)\phi(Y(\omega, t))^H]W(\omega) \tag{15}$$

In the gradient method with an orthogonality restriction, a modification value $\Delta W(\omega)$ of the separation matrix $W(\omega)$ is determined in accordance with the expression (15) above, and $W(\omega)$ is updated in accordance with the expression (8). If the loop processes of the expressions (15), (8) and (9) are repeated many times, then the elements of $W(\omega)$ finally converge to certain values, which make estimated values of the separation matrix. Then, a result when a separation process is performed using the separation matrix makes a final separation signal. In the method in which the expression (15) given above is used, since it involves the orthogonality restriction, the converge is reached by a number of times of execution of the loop processes smaller than that where the expression (7) given hereinabove is used.

SUMMARY OF THE INVENTION

Incidentally, in the independent component analysis in the time-frequency domain described above, the signal separation process is performed for each frequency bin as described hereinabove with reference to FIG. 10, but a relationship between the frequency bins is not taken into consideration. Therefore, even if the separation itself results in success, there is the possibility that inconsistency of the separation destination may occur among the frequency bins. The inconsistency of the separation destination signifies such a phenomenon that, for example, while, where ω=1, a signal originating from $S_1$ appears at $Y_1$, where ω=2, a signal originating from $S_2$ appears at $Y_1$. This is called problem of permutation.

An example of the permutation is illustrated in FIGS. 12A and 12B. FIG. 12A illustrates spectrograms produced from two files of "rsm2_mA.wav" and "rsm2_mB.wav" in the WEB page (http://www.cnl.salk.edu/~tewon/Blind/blindaudo.html" and represents an example of an observation signal wherein speech and music are mixed. Each spectrogram was produced by Fourier transforming data of 40,000 samples from the top of the file with a shift width of 128 using a Hanning window of a window length of 512. Meanwhile, FIG. 12B illustrates spectrograms of separation signals when the two spectrograms of FIG. 12A were used as observation signals and arithmetic operation of the expressions (15), (8) and (9) was repeated by 200 times. The expression (13) given hereinabove was used as the score function cp. As can be seen from FIG. 12B, permutation appears notably at frequency bins in the proximity of positions to which arrow marks are applied.

In this manner, the conventional independent component analysis of the time-frequency domain suffers from a problem of permutation. It is to be noted that, for the independent component analysis with an orthogonality restriction, also methods which use a fixed point method and the Jacob method are available in addition to the gradient method defined by the expressions (14) and (15) given hereinabove. The methods mentioned are disclosed in "3.4 Fixed point method" and "Jacob method" of Non-Patent Document 1 mentioned hereinabove. Also examples wherein the methods are applied to independent component analysis of the time-frequency domain are known and disclosed, for example, in Horoshi SΔWADA, Ryo MUKAI, Akiko ARAKI and Shoji MAKINO, "Blind separation or three or more sound sources in an actual environment", 2003 Autumnal Meeting for Reading Papers of the Acoustical Society of Japan, pp. 547-548 (hereinafter referred to as Non-Patent Document 2). However, both methods suffer from a problem of permutation because a signal separation process is performed for each frequency bin.

Conventionally, in order to eliminate the problem of permutation, a method is known which involves replacement by a post-process. In the post-process, after such spectrograms as illustrated in FIG. 12B are obtained by separation for each frequency bin, replacement of separation signals is performed between different channels in accordance with some reference to obtain spectrograms which do not involve permutation. As the reference for replacement, (a) similarity of an envelope (refer to Non-Patent Document 1), (b) an estimated sound source direction (refer to the description of "Prior Art" of Japanese Patent Laid-Open No. 2004-145172 (hereinafter referred to as Patent Document 1), and (c) a combination of (a) and (b) (refer to Patent Document 1) can be applied.

However, according to the reference (a) above, if such a situation that occasionally the difference between envelopes is unclear depending upon frequency bins occurs, then an error in replacement occurs. Further, if wrong replacement occurs once, then the separation destination is mistaken in all of the later frequency bins. Meanwhile, the reference (b) above has a problem in accuracy in direction estimation and besides requires position information of microphones. Further, although the reference (c) above is advantageous in that the accuracy in replacement is enhanced, it requires position information of microphones similarly to the reference (b). Further, all methods have a problem that, since the two steps of separation and replacement are involved, the processing time is long. From the point of view of the processing time, preferably also the problem of permutation is eliminated at a point of time when the separation is completed. However, this is difficult with the method which uses the post-process.

Therefore, it is demanded to provide a speech signal separation apparatus and method which can eliminate, when a speech signal with which a plurality of signals are mixed is separated into the signals using the independent component analysis, the problem of permutation without performing a post-process after the separation.

According to an embodiment of the present invention, there is provided a speech signal separation apparatus for separating an observation signal in a time domain of a plurality of channels wherein a plurality of signals including a speech signal are mixed using independent component analysis to produce a plurality of separation signals of the different channels, including a first conversion section configured to convert the observation signal in the time domain into an observation signal in a time-frequency domain, a non-correlating section configured to non-correlate the observation signal in the time-frequency domain between the channels, a separation section configured to produce separation signals in the time-frequency domain from the observation signal in the time-frequency domain, and a second conversion section configured to convert the separation signals in the time-frequency domain into separation signals in the time domain, the separation section being operable to produce the separation signals in the time-frequency domain from the observation signal in the time-frequency domain and a separation matrix in which initial values are substituted, calculate modification values for the separation matrix using the separation signals in the time-frequency domain, a score function which uses a multi-dimensional probability density function, and the separation matrix, modify the separation matrix until the separation matrix substantially converges using the modification values and produce separation signals in the time-frequency domain using the substantially converged separation matrix, each of the separation matrix which includes the initial values and the separation matrix after the modification which includes the modification values being a normal orthogonal matrix.

According to another embodiment of the present invention, there is provided a speech signal separation method for separating an observation signal in a time domain of a plurality of channels wherein a plurality of signals including a speech signal are mixed using independent component analysis to produce a plurality of separation signals of the different channels, including the steps of converting the observation signal in the time domain into an observation signal in a time-frequency domain, non-correlating the observation signal in the time-frequency domain between the channels, producing separation signals in the time-frequency domain from the observation signal in the time-frequency domain and a separation matrix in which initial values are substituted, calculating modification values for the separation matrix using the separation signals in the time-frequency domain, a score function which uses a multi-dimensional probability density function, and the separation matrix, modifying the separation matrix using the modification values until the separation matrix substantially converges, and converting the separation signals in the time-frequency domain produced using the substantially converged separation matrix into separation signals in the time domain, each of the separation matrix which includes the initial values and the separation matrix after the modification which includes the modification values being a normal orthogonal matrix.

In the speech signal separation apparatus and method, in order to separate an observation signal in a time domain of a plurality of channels wherein a plurality of signals including a speech signal are mixed using independent component analysis to produce a plurality of separation signals of the different channels, separation signals in the time-frequency domain are produced from the observation signal in the time-frequency domain and a separation matrix in which initial values are substituted. Then, modification values for the separation matrix are calculated using the separation signals in the time-frequency domain, a score function which uses a multi-dimensional probability density function, and the separation matrix. Thereafter, the separation matrix is modified using the modification values until the separation matrix substantially converges. Then, the separation signals in the time-frequency domain produced using the substantially converged separation matrix are converted into separation signals in the time domain. Consequently, the problem of permutation can be eliminated without performing a post-process after the separation. Further, since the observation signal in the time-frequency domain is non-correlated between the channels in advances and each of the separation matrix which includes the initial values and the separation matrix after the modification which includes the modification values is a normal orthogonal matrix, the separation matrix converges through of a comparatively small number of times of execution of the loop process.

The above and other features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

Figure 1:
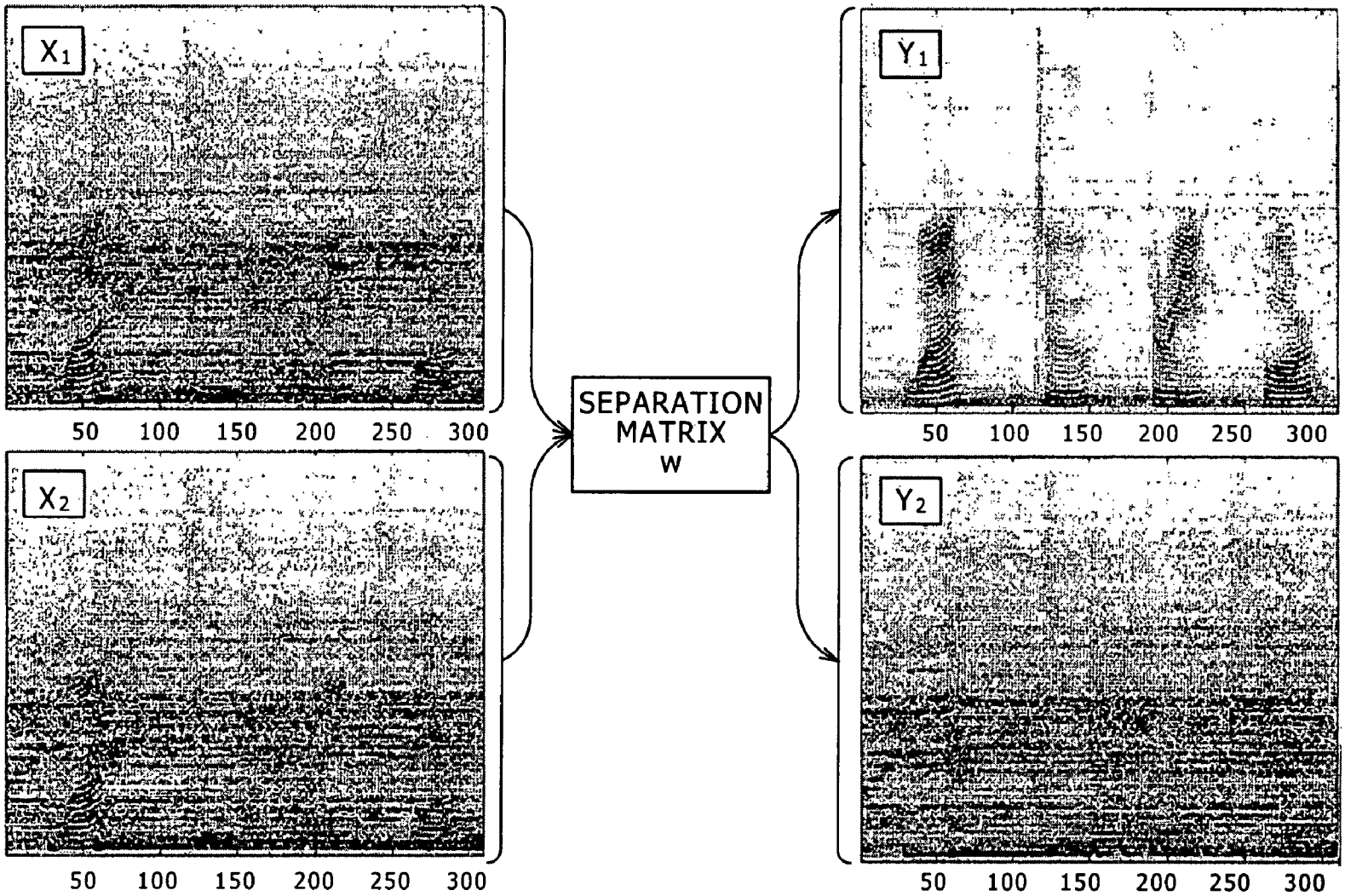
FIG. 1 is a view illustrating a manner in which a signal separation process is performed over entire spectrograms.

In the following, a particular embodiment of the present invention is described in detail with reference to the accompanying drawings. In the present embodiment, the invention is applied to a speech signal separation apparatus which separates a speech signal with which a plurality of signals are mixed into the individual signals using the independent component analysis. While conventionally a separation matrix $W(\omega)$ is used to separate signals for individual frequencies as described hereinabove, in the present embodiment, a separation matrix W is used to separate signals over entire spectrograms as seen in FIG. 1. In the following, particular calculation expressions used in the present embodiment are described, and then a particular configuration of the speech signal separation apparatus of the present invention is applied.

If conventional separation for each frequency bin is represented by a matrix and a vector, then it can be represented as the expression (9) given hereinabove. If this expression (9) is developed for all $\omega$ ($1 \leqq \omega \leqq M$) and represented in the form of the product of a matrix and a vector, then such an expression (16) given below is obtained. This expression (16) represents matrix arithmetic operation for separating the entire spectrograms. If the opposite sides of the expression (16) are represented using characters $Y(t)$, W and $X(t)$, then the expression (17) given below is obtained. Further, if the components for each channel of the expression (16) are each represented by one character, then the expression (18) given below is obtained. In the expression (18), $Y_k(t)$ represents a column vector produced by cutting out a spectrum of the frame number t from within the spectrogram of the channel number k.

$$\begin{bmatrix} Y_1(1,t) \\ \vdots \\ Y_1(M,t) \\ \hline Y_2(1,t) \\ \vdots \\ Y_2(M,t) \\ \hline \vdots \\ \hline Y_n(1,t) \\ \vdots \\ Y_n(M,t) \end{bmatrix} = \left[\begin{array}{ccc|ccc|c|ccc} w_{11}(1) & & 0 & w_{12}(1) & & 0 & \cdots & w_{1n} & & 0 \\ & \ddots & & & \ddots & & \cdots & & \ddots & \\ 0 & & w_{11}(M) & 0 & & w_{12}(M) & \cdots & 0 & & w_{1n}(M) \\ \hline w_{21}(1) & & 0 & w_{22}(1) & & 0 & \cdots & w_{2n}(1) & & 0 \\ & \ddots & & & \ddots & & \cdots & & \ddots & \\ 0 & & w_{11}(M) & 0 & & w_{22}(M) & \cdots & 0 & & w_{2n}(M) \\ \hline \vdots & \vdots & \vdots & \vdots & \vdots & \vdots & \ddots & \vdots & \vdots & \vdots \\ \hline w_{n1} & & 0 & w_{n2}(1) & & 0 & \cdots & w_{nn} & & 0 \\ & \ddots & & & \ddots & & \cdots & & \ddots & \\ 0 & & w_{n1}(M) & 0 & & w_{n2}(M) & \cdots & 0 & & w_{nn}(M) \end{array}\right] \begin{bmatrix} X_1(1,t) \\ \vdots \\ X_1(M,t) \\ \hline X_2(1,t) \\ \vdots \\ X_2(M,t) \\ \hline \vdots \\ \hline X_n(1,t) \\ \vdots \\ X_n(M,t) \end{bmatrix} \tag{16}$$

$$= Y(t) = WX(t) \tag{17}$$

$$= \begin{bmatrix} Y_1(t) \\ Y_2(t) \\ \vdots \\ Y_n(t) \end{bmatrix} = \begin{bmatrix} W_{11} & W_{12} & \cdots & W_{1n} \\ W_{21} & W_{22} & \cdots & W_{2n} \\ \vdots & \vdots & \ddots & \vdots \\ W_{n1} & W_{n2} & \cdots & W_{nn} \end{bmatrix} = \begin{bmatrix} X_1(t) \\ X_2(t) \\ \vdots \\ X_n(t) \end{bmatrix} \tag{18}$$

where $$Y_k(t) = \begin{bmatrix} Y_k(1,t) \\ \vdots \\ Y_k(M,t) \end{bmatrix} \tag{19}$$

$$W_{ij} = diag(w_{ij}(1), \ldots, w_{ij}(M))$$

$$X_k(t) = \begin{bmatrix} X_k(1,t) \\ \vdots \\ X_k(M,t) \end{bmatrix}$$

In the present embodiment, a further restriction of normal orthogonality is provided to the separation matrix W of the expression (17) given above. In other words, a restriction represented by the expression (20) given below is applied to the separation matrix W. In the expression (20), $I_{nM}$ represents a unit matrix of nM×nM. However, since the expression (20) is equivalent to the expression (21) given below, the restriction to the separation matrix W may be applied for each frequency bin similarly as in the prior art. Further, since the expression (20) and the expression (21) are equivalent to each other, also a pre-process (hereinafter described) of correlating which is applied to an observation signal in advance may be performed for each frequency bin similarly as in the prior art.

$$WW^H = I_{nM} \tag{20}$$

$$\text{all } \omega\text{s correspond to } W(\omega)W(\omega)^H = I_n \tag{21}$$

Further, in the present embodiment, also the scale representative of the independency of a signal is calculated from the entire spectrograms. As described hereinabove, while the KL information amount, kurtosis and so forth are available as the scale representative of the independency of a signal in the independent component analysis, here the KL information amount is used as an example.

Figure 2:
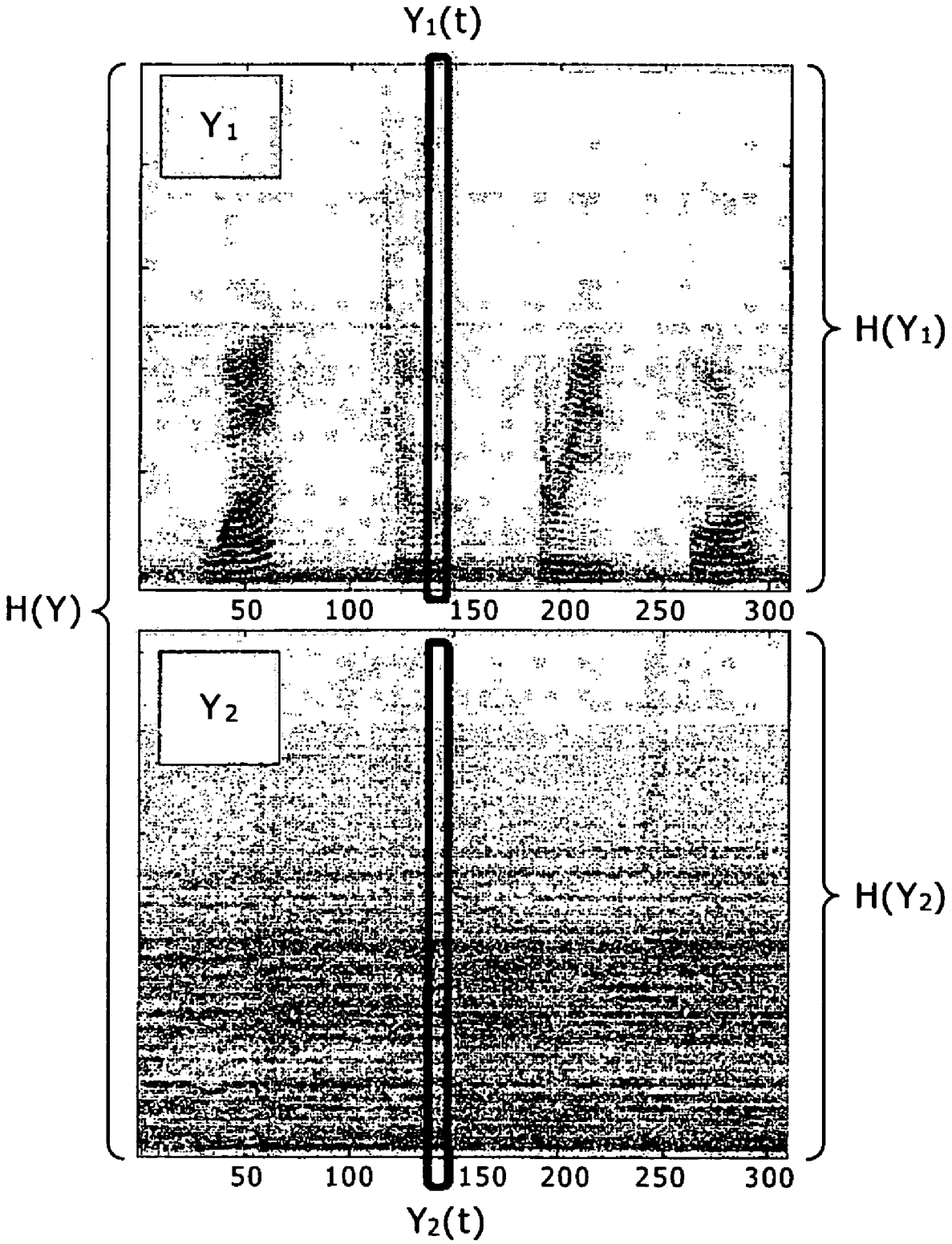
FIG. 2 is a view illustrating entropy and simultaneous entropy where the present invention is applied.

In the present embodiment, the KL information amount I(Y) of the entire spectrograms is defined as given by the expression (22) below. In particular, a value obtained by subtracting the simultaneous entropy H(Y) regarding all channels from the sum total of the entropy $H(Y_k)$ regarding each channel is defined as the KL information amount I(Y). A relationship between the entropy $H(Y_k)$ and the simultaneous entropy H(Y) where n=2 is illustrated in FIG. 2. $H(Y_k)$ of the expression (22) is re-written into the first term of the expression (23) given below from the definition of the entropy, and H(Y) is expanded like the second and third terms of the expression (23) from the relationship of Y=WX. In the expression (23), $PY_k(Y_k(t))$ represents the probability density function of Yk(t), and H(X) represents the simultaneous entropy of the observation signals X.

$$I(Y) = \sum_{k=1}^{n} H(Y_k) - H(Y) \tag{22}$$

$$= \sum_{k=1}^{n} E_k[-\log P_{Y_k}(Y_k(t))] - \log|\det(W)| - H(X) \tag{23}$$

where $$Y_k = [Y_k(1) \cdots Y_k(T)]$$

$$Y = \begin{bmatrix} Y_l \\ \vdots \\ Y_n \end{bmatrix}$$

$$X = [X(1) \cdots X(T)]$$

Since the KL information amount I(Y) exhibits a minimum value (ideally 0) where $Y_1$ to $Y_n$ are independent of one another, in the separation process, a separation matrix W which minimizes the KL information amount I(Y) and satisfies the normal orthogonality restriction is determined.

In the present embodiment, in order to determine such a separation matrix W as described above, a gradient method with the normal orthogonality restriction represented by the expressions (24) to (26) is used. In the expression (24), f(•) represents an operation by which, when ΔW satisfies the normal orthogonality restriction, that is, when W is a normal orthogonal matrix, also W+η·ΔW becomes a normal orthogonal matrix.

$$\Delta W = f\left(-\frac{\partial I(Y)}{\partial W} W^H W\right) \tag{24}$$

$$W \leftarrow W + \eta \cdot \Delta W \tag{25}$$

$$Y = WX \tag{26}$$

In the gradient method with the normal orthogonality restriction, a modified value ΔW of the separation matrix W is determined in accordance with the expression (24) above and the separation matrix W is updated in accordance with the expression (25), and then the updated separation matrix W is used to produce a separation signal in accordance with the expression (26). If the loop processes of the expressions (24) to (26) are repeated many times, then the elements of the separation matrix W finally converge to certain values, which make estimated values of the separation matrix. Then, a result when the separation process is performed using the separation matrix makes a final separation signal. Particularly in the present embodiment, a KL information amount is calculated from the entire spectrograms, and the separation matrix W is used to separate signals over the entire spectrograms. Therefore, no permutation occurs with the separation signals.

Here, since the matrix ΔW is a discrete matrix similarly to the separation matrix W, it has a comparatively high efficiency if an expression for updating non-zero elements is used. Therefore, the matrices ΔW (ω) and W(ω) which are composed only of elements of an ωth frequency bin are defined as represented by the expressions (27) and (28) given below, and the matrix ΔW(ω) is calculated in accordance with the expression (29) given below. If this expression (2) is defined for all ω, then this results in calculation of all non-zero elements in the matrix ΔW. The W+η·ΔW determined in this manner has a form of a normal orthogonal matrix.

$$\Delta W(\omega) = \begin{bmatrix} \Delta w_{11}(\omega) & \cdots & \Delta w_{1n}(\omega) \\ \vdots & \iddots & \vdots \\ \Delta w_{n1}(\omega) & \cdots & \Delta w_{nn}(\omega) \end{bmatrix} \tag{27}$$

$$W(\omega) = \begin{bmatrix} w_{11}(\omega) & \cdots & w_{1n}(\omega) \\ \vdots & \iddots & \vdots \\ w_{n1}(\omega) & \cdots & w_{nn}(\omega) \end{bmatrix} \tag{28}$$

$$\Delta W(\omega) = [E_t[\phi_k(Y(t))Y(\omega, t)^H - Y(\omega, t)\phi_\omega(Y(t))^H]]W(\omega) \tag{29}$$

where $$\phi_\omega(Y(t)) = \begin{bmatrix} \varphi_{k\omega}(Y_1(t)) \\ \vdots \\ \varphi_{k\omega}(Y_n(t)) \end{bmatrix} \tag{30}$$

$$\phi_{k\omega}(Y_k(t)) = \frac{\partial}{\partial Y_k(\omega, t)} \log P_{Y_k}(Y_k(t)) = \frac{\frac{\partial}{\partial Y_k(\omega, t)} P_{Y_k}(Y_k(t))}{P_{Y_k}(Y_k(t))} \tag{31}$$

In the expression (30) above, the function $\phi_{k\omega}(Y_k(t))$ is partial differentiation of a logarithm of the probability density function with the ωth argument as in the expression (31) above and is called score function (or activation function). In the present embodiment, since a multi-dimensional probability density function is used, also the score function is a multi-dimensional (multi-variable) function.

In the following, a derivation method of the score function and a particular example of the score function are described.

One of methods of deriving a score function is to construct a multi-dimensional probability density function in accordance with the expression (32) given below and differentiate a logarithm of the multi-dimensional probability density function. In the expression (32), h is a constant for adjusting the sum total of the probability to 1. However, since h disappears through reduction in the process of derivation of a score function, there is no necessity to substitute a particular value into h. Further, f(•) represents an arbitrary scalar function. Furthermore, $\|Y_k(t)\|_2$ is an L2 norm of $Y_k(t)$ and is an $L_N$ norm calculated in accordance with the expression (33) given below where N=2.

$$P_{Yk}(Y_k(t))=hf(K\|Y_k(t)\|_2) \tag{32}$$

where $$\|Y_k(t)\|_N = \left\{\sum_{\omega=1}^{M} |Y_k(\omega, t)|^N\right\}^{1/N} \tag{33}$$

An example of the multi-dimensional probability density function is given as the expressions (34) and (36) below and the score function in this instance is given as the expression (35) and (37) below. In this instance, the differentiation of an absolute value of a complex number is defined as given by the expression (38) below.

$$P_{Yk}(Y_k(t)) = \frac{h}{\cosh^{-}(K\|Y_k(t)\|_2)} \tag{34}$$

$$\phi_{k\omega}(Y_k(t)) = -mK\tanh(K\|Y_k(t)\|_2)\frac{Y_k(\omega, t)}{\|Y_k(t)\|_2} \tag{35}$$

$$P_{Yk}(Y_k(t)) = h\exp(-K\|Y_k(t)\|_2) \tag{36}$$

$$\phi_{k\omega}(Y_k(t)) = -K\frac{Y_k(\omega, t)}{\|Y_k(t)\|_2} \tag{37}$$

$$\frac{\partial}{\partial Y_k(\omega, t)}|Y_k(\omega, t)| = \frac{Y_k(\omega, t)}{|Y_k(\omega, t)|} \tag{38}$$

Also it is possible to directly construct a score function without intervention of a multi-dimensional probability density function without deriving a score function through intervention of a multi-dimensional probability density function as described above. To this end, a score function may be construct so as to satisfy the following conditions i) and ii). It is to be noted that the expressions (35) and (37) satisfy the conditions i) and ii).

i) That the return value is a dimensionless amount.

ii) That the phase of the return value (phase of a complex number) is opposite to the phase of the ωth argument $Y_k(\omega, t)$.

Here, that the return value of the score function $\phi_{k\omega}(Y_k(t))$ is a dimensionless amount signifies that, where the unit of $\phi_{k\omega}(Y_k(t))$ is represented by [x], [x] cancels between the numerator and the denominator of the score function and the return value does not include the dimension of [x] (where n is a real number, whose unit is described as [$x^n$]).

Meanwhile, that the phase of the return value of the function $\phi_{k\omega}(Y_k(t))$ is opposite to the phase of the ωth argument $Y_k(\omega, t)$ represents that $\arg\{\phi_{k\omega}(Y_k(t))\}-\arg\{\phi_{k\omega}(Y_k(\omega, t))$ is satisfied with any $Y_k(\omega, t)$. It is to be noted that arg{z} represents a phase component of the complex number z. For example, where the complex number z is represented as $z=r\cdot\exp(i\theta)$ using the magnitude r and the phase angle θ, $\arg\{z\}=\theta$.

It is to be noted that, since, in the present embodiment, the score function is defined as a differential of $\log P_{Yk}(Y_k(t))$, that the phase of the return value is "opposite" to the phase of the ωth argument makes a condition of the score function. However, where the score function is defined otherwise as a differential of $\log(1/P_{Yk}(Y_k(t)))$, that the phase of the return value is "same" as the phase of the ωth argument makes a condition of the score function. In any case, the score function relies only upon the phase of the ωth argument.

A particular example of the score function which satisfies both of the conditions i) and ii) described hereinabove is represented by the expressions (39) and (40) given below. The expression (39) is a generalized form of the expression (35) given hereinabove with regard to N so that separation can be performed without permutation also in any norm other than the L2 norm. Also the expression (40) is a generalized form of the expression (37) given hereinabove with regard to N. In the expressions (39) and (40), L and m are positive constants and may be, for example, 1. Meanwhile, a is a constant for preventing division by zero and has a non-negative value.

$$\phi_{k\omega}(Y_k(t)) = -K\text{lm}\tanh(K\|Y_k(t)\|_N^m)\left(\frac{|Y_k(\omega, t)|}{\|Y_k(t)\|_N + a}\right)^L \frac{Y_k(\omega, t)}{|Y_k(\omega, t)|} \tag{39}$$

$$(L > 0,\ a \geq 0)$$

$$\phi_{k\omega}(Y_k(t)) = -K\left(\frac{|Y_k(\omega, t)|}{\|Y_k(t)\|_N + a}\right)^L \frac{Y_k(\omega, t)}{|Y_k(\omega, t)|} \tag{40}$$

$$(L > 0)$$

Where the unit of $Y_k(\omega, t)$ in the expressions (39) and (40) is [x], an equal number (L+1) of amounts which have [x] appear with the numerator and the denominator, and therefore, the unit [x] cancels between them. Consequently, the entire score function provides a dimensionless amount (tan h is regarded as a dimensionless amount). Further, since the phases of the return values of the expressions above are equal to the phase of $-Y_k(\omega, t)$ (the other terms do not have an influence on the phase), the phases of the return values have a phase opposite to that of the ωth argument $Y_k(\omega, t)$.

A further generalized score function is given as the expression (41) below. In the expression (41), g(x) is a function which satisfies the following conditions iii) to vi).

iii) That $g(x)\geqq 0$ where $x\geqq 0$.

iv) That, where $x\geqq 0$, g(x) is a constant, a monotonically increasing function or a monotonically decreasing function.

v) That, where g(x) is a monotonically increasing function or a monotonically decreasing function, g(x) converges to a positive value when $x\rightarrow\infty$.

vi) g(x) is a dimensionless amount with regard to x.

$$\phi_{k\omega}(Y_k(t)) = -mg(K\|Y_k(t)\|_N)\left(\frac{|Y_k(\omega, t)| + a_2}{\|Y_k(t)\|_N + a_1}\right)^L \frac{Y_k(\omega, t)}{|Y_k(\omega, t)| + a_3} \tag{41}$$

$$(m > 0,\ L,\ a_1,\ a_2,\ a_3 \geq 0)$$

Examples of g(x) which provide success in separation are given below as the expressions (42) to (46). In the expressions (42) to (46), the constant terms are determined so as to satisfy the conditions iii) to v) given hereinabove.

$$g(x) = b \pm \tanh(Kx) \tag{42}$$

$$g(x) = 1 \tag{43}$$

$$g(x) = \frac{x + b_2}{x + b_1}(b_1, b_2 \geq 0) \tag{44}$$

$$g(x) = 1 \pm h\exp(-Kx)(0 < h < 1) \tag{45}$$

$$g(x) = b \pm \arctan(Kx) \tag{46}$$

It is to be noted that, in the expression (41) above, m is a constant independent of the channel number k and the frequency bin number ω, but may otherwise vary depending upon k or ω. In other words, m may be replaced by $m_k(\omega)$ as in the expression (47) given below. Where $m_k(\omega)$ is used in this manner, the scale of $Y_k(\omega, t)$ upon convergence can be adjusted to some degree.

$$\phi_{k\omega}(Y_k(t)) \approx -m_k(\omega)g(K\|Y_k(t)\|_N)\left(\frac{|Y_k(\omega, t)| + a_2}{\|Y_k(t)\|_N + a_1}\right)^L \frac{Y_k(\omega, t)}{|Y_k(\omega, t)| + a_3} \tag{47}$$

$$(m > 0, L, a_1, a_2, a_3 \geq 0)$$

Here, when the $L_N$ norm $\|Y_k(t)\|_N$ of $Y_k(t)$ in the expressions (39) to (41) and (47) is to be calculated, it is necessary to determine an absolute value of a complex number. However, the absolute value of a complex number may otherwise be approximated with an absolute value of the real part or the imaginary part as given by the expression (48) or (49) below, or may be approximated with the sum of the absolute values as given by the expression (50).

$$|Y_k(\omega,t)| \approx |Re(Y_k(\omega,t))| \tag{48}$$

$$|Y_k(\omega,t)| \approx |Im(Y_k(\omega,t))| \tag{49}$$

$$|Y_k(\omega,t)| \approx |Re(Y_k(\omega,t))| + |Im(\omega,t)| \tag{50}$$

In a system wherein a complex number is retained separately as a real part and an imaginary part, the absolute value of a complex number z represented by z=x+iy (x and y are real numbers and i is the imaginary unit) is calculated in accordance with the expression (51) given below. On the other hand, since the absolute values of the real part and the imaginary part are calculated in accordance with the expressions (52) and (53) given below, the amount of calculation is reduced. Particularly in the case of the L1 norm, since the absolute value can be calculated only by the calculation and the sum of absolute values of real numbers without using the square or the square root, the calculation can be simplified significantly.

$$|z| = \sqrt{x^2 + y^2} \tag{51}$$

$$|Re(z)| = |x| \tag{52}$$

$$|Im(z)| = |y| \tag{53}$$

Further, since the value of the $L_N$ norm almost depends upon a component of $Y_k(t)$ which has a high absolute value, upon calculation of the $L_N$ norm, not all components of $Y_k(t)$ may be used, but only x % of a comparatively high order of a high absolute value component or components may be used. The high order x % can be determined in advance from a spectrogram of an observation signal.

A further generalized score function is given as the expression (54) below. This score function is represented by the product of a function $f(Y_k(t))$ wherein a vector $Y_k(t)$ is an argument, another function $g(Y_k(\omega, t))$ wherein a scalar $Y_k(\omega, t)$ is an argument, and the term $-Y_k(\omega, t)$ for determining the phase of the return value (f(•) and g(•) are different from the functions described hereinabove). It is to be noted that $f(Y_k(t)$ and $g(Y_k(\omega, t))$ are determined so that the product of them satisfies the following conditions vii) and viii) with regard to any $Y_k(t)$ and $Y_k(\omega, t)$.

vii) That the product of $f(Y_k(t))$ and $g(Y_k(\omega, t))$ is a non-negative real number.

viii) That the dimension of the product of $f(Y_k(t))$ and $g(Y_k(\omega, t))$ is [1/x].

(The unit of $Y_k(\omega, t)$ is [x]).

$$\phi_{k\omega}(Y_k(t)) = -m_k(\omega)f(Y_k(t))g(Y_k(\omega,t))Y_k(\omega,t) \tag{54}$$

From the condition vii) above, the phase of the score function becomes same as that of $-Y_k(\omega, t)$, and the condition that the phase of the return value of the score function is opposite to the phase of the ωth argument is satisfied. Further, from the condition viii) above, the dimension is canceled with that of $Y_k(\omega, t)$, and the condition that the return value of the score function is a dimensionless amount is satisfied.

The particular calculation expressions used in the present embodiment are described above. In the following, a particular configuration of the speech signal separation apparatus according to the present embodiment is described.

Figure 3:
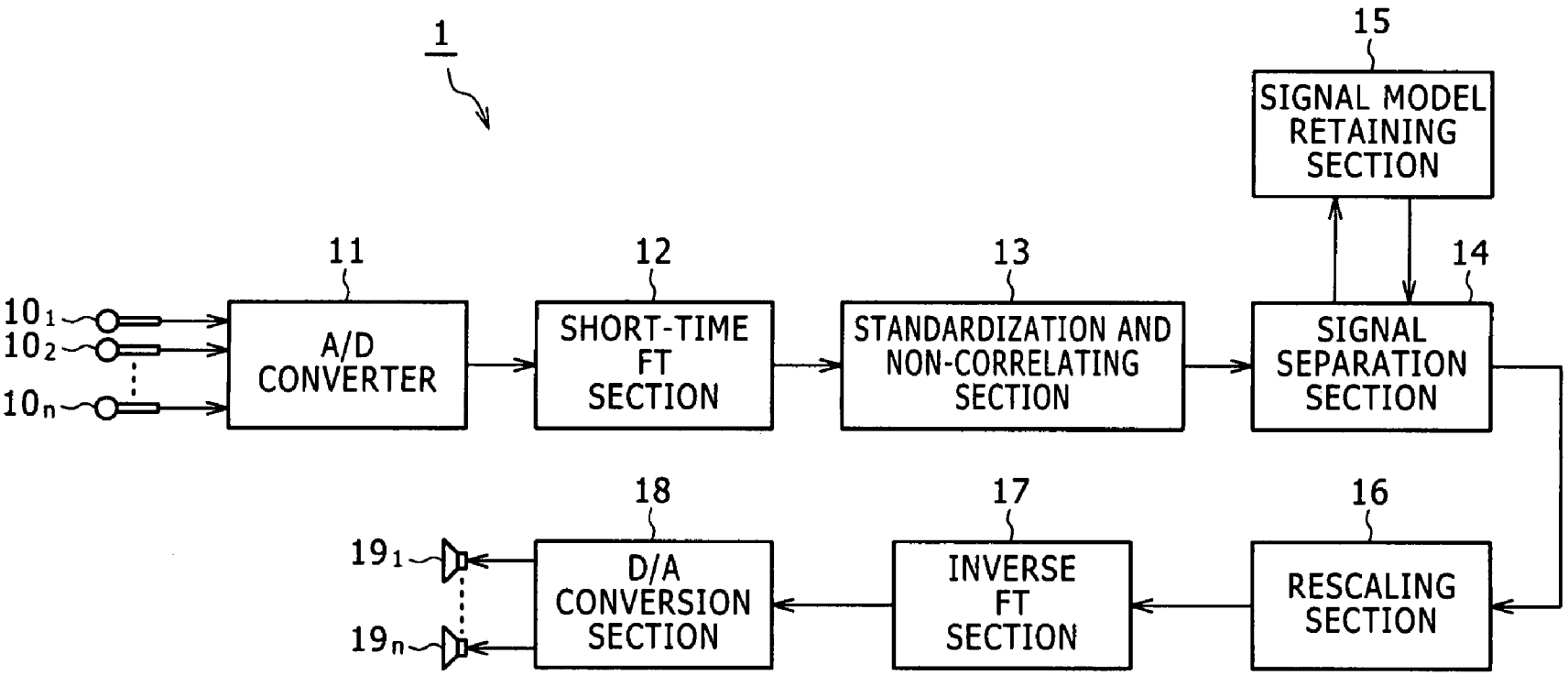
FIG. 3 is a block diagram showing a general configuration of a speech signal separation apparatus to which the present invention is applied.

A general configuration of the speech signal separation apparatus according to the present embodiment is shown in FIG. 3. Referring to FIG. 3, the speech signal separation apparatus generally denoted by 1 includes n microphones $\mathbf{10}_1$ to $\mathbf{10}_n$ for observing independent sounds emitted from n sound sources, and an A/D (Analog/Digital) converter 11 for A/D converting the sound signals to obtain an observation signal. A short-time Fourier transform (F/G) section 12 short-time Fourier transforms the observation signal to produce spectrogram of the observation signal. A standardization and non-correlating section 13 performs a standardization process (adjustment of the average and the variance) and a non-correlating process (non-correlating between channels) for the spectrograms of the observation signal. A signal separation section 14 makes use of signal models retained in a signal model retaining section 15 to separate the spectrograms of the observation signals into spectrograms based on independent signals. A signal model particularly is a score function described hereinabove.

A rescaling section 16 performs a process of adjusting the scale among the frequency bins of the spectrograms of the separation signals. Further, the rescaling section 16 performs a process of canceling the effect of the standardization process on the observation signal before the separation process. An inverse Fourier transform section 17 performs an inverse Fourier transform process to convert the spectrograms of the separation signals into separation signals in the time domain. A D/A conversion section 18 D/A converts the separation signals in the time domain, and n speakers $\mathbf{19}_1$ to $\mathbf{19}_n$ reproduce sounds independent of each other.

Figure 4:
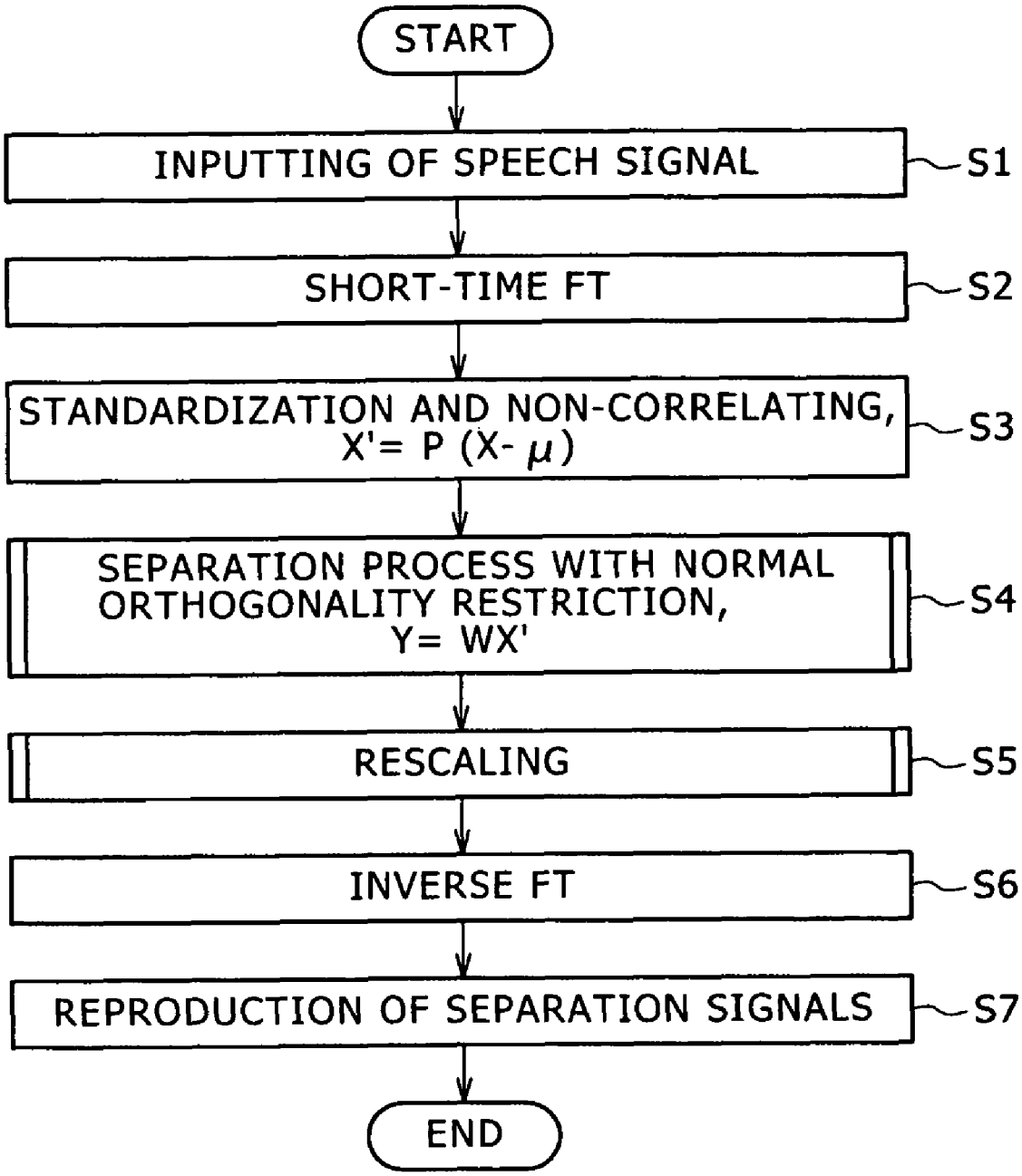
FIG. 4 is a flow chart illustrating an outline of a process of the speech signal separation apparatus.

An outline of the process of the speech signal separation apparatus is described with reference to a flow chart of FIG. 4. First at step S1, sound signals are observed through the microphones, and at step S2, the observation signal is short-time Fourier transformed to obtain spectrograms. Then at step S3, a standardization process and a non-correlating process are performed for the spectrograms of the observation signals.

The standardization here is an operation of adjusting the average and the standard deviation of the frequency bins to zero and one, respectively. An average value is subtracted for each frequency bin to adjust the average to zero, and the standardization deviation can be adjusted to 1 by dividing resulting spectrograms by the standard deviations. Where an observation signal after the standardization is represented by X', the standardized observation signal can be represented as $X'=P(X-\mu)$. It is to be noted that P represents a variation standardization matrix composed of inverse numbers of the standard deviations, and $\mu$ represents an average value vector formed from average values of the frequency bins.

Meanwhile, the non-correlating is also called whitening or sphering and is an operation of reducing the correlation between channels to zero. The non-correlating may be performed for each frequency bin similarly as in the prior art.

The non-correlating is further described. A variance-covariance matrix $\Sigma(\omega)$ of the observation signal vector $X(\omega, t)$ at the frequency bin=$\omega$ is defined as given by the expression (55) below. This variance-covariance matrix $\Sigma(\omega)$ can be represented as given by the expression (56) below using the unique vector $p_k(\omega)$ and a characteristic value $\lambda_k(\omega)$. Where a matrix composed of unique vectors $p_k(\omega)$ is represented by $P(\omega)$ and a diagonal matrix composed of characteristic values $\lambda_k(\omega)$ is represented by $\Lambda(\omega)$, if $X(\omega, t)$ is converted as given by the expression (57) below, then the elements of $X'(\omega, t)$ which is a result of the conversion are not correlating to each other. In other words, the condition of $E_t[X'(\omega, t)X'(\omega, t)^H]=I_n$ is satisfied.

$$\sum(\omega) = E_t[X(\omega, t)X(\omega, t)^H] \tag{55}$$

$$\sum(\omega)p_k(\omega) = p_k(\omega)\lambda_k(\omega) \tag{56}$$

$$X'(\omega, t) = P(\omega)^H\Lambda(\omega)^{-1/2}P(\omega)X(\omega, t) = U(\omega)X(\omega, t) \tag{57}$$

where $$P(\omega) = [p_1(\omega)\ \ldots\ p_n(\omega)]$$

$$\Lambda(\omega)^{-1/2} = \mathrm{diag}(\lambda_1(\omega)^{-1/2},\ \ldots,\ \lambda_n(\omega)^{-1/2})$$

$$Y(\omega, t) = W(\omega)X'(\omega, t) = W(\omega)U(\omega)X(\omega, t)$$

Then at step S4, a separation process is performed for the standardized and non-correlated observation signal. In particular, a separation matrix W and a separation signal Y are determined. It is to be noted that, while normal orthogonality restriction is applied to the process at step S4, details are hereinafter described. The separation signal Y obtained at step S4 exhibits scales which are different among different frequency bins although it does not suffer from permutation. Thus, at step S5, a rescaling process is performed to adjust the scale among the frequency bins. Here, also a process of restoring the averages and the standard deviations which have been varied by the standardization process is performed. It is to be noted that details of the rescaling process at step S5 are hereinafter described. Then at step S6, the separation signals after the rescaling process at step S5 are converted into separation signals in the time domain, and at step S7, the separation signals in the time domain are reproduced from the speakers.

Figure 5:
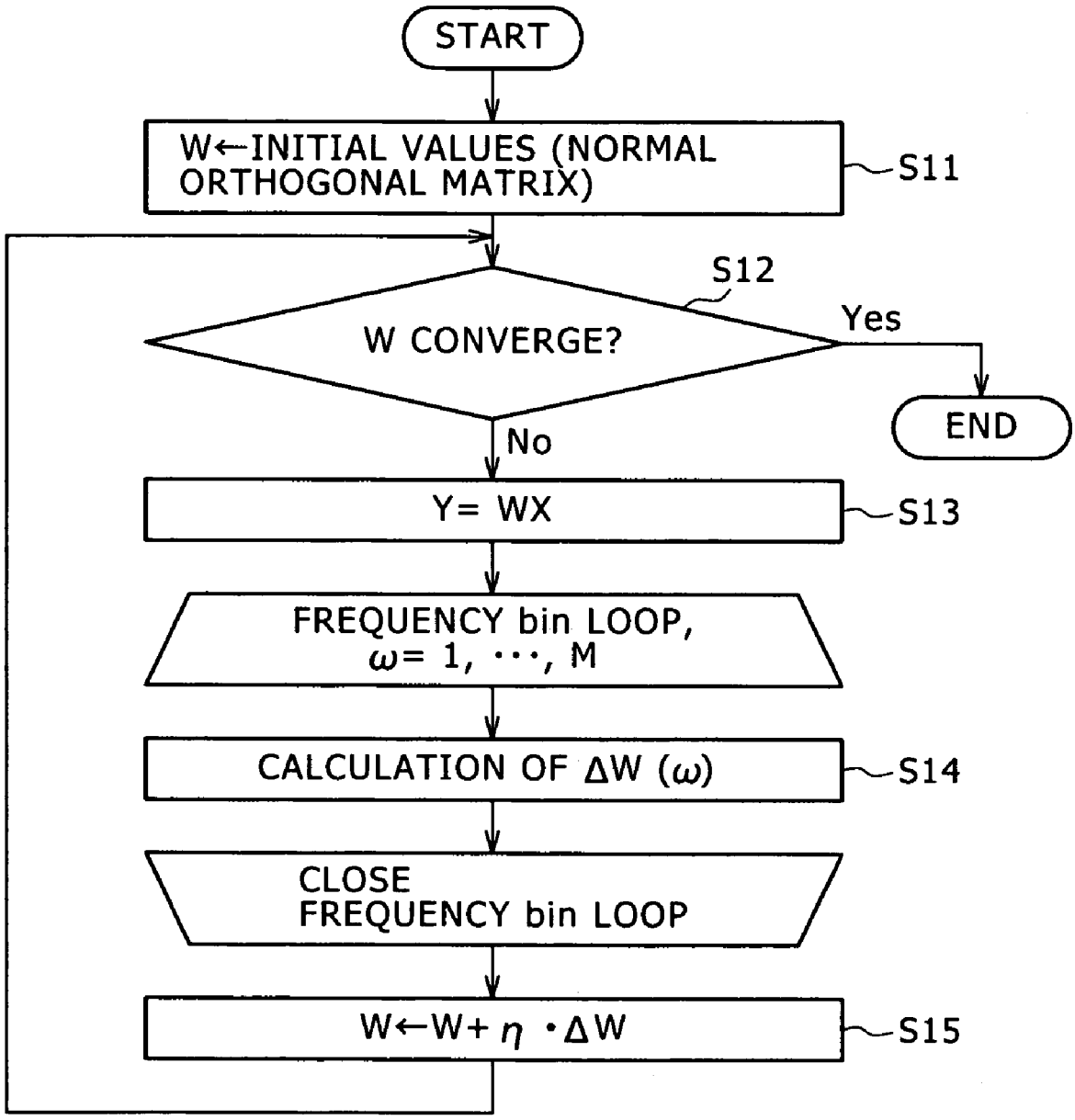
FIG. 5 is a flow chart illustrating details of a separation process in the process of FIG. 4.

Details of the separation process at step S4 (FIG. 4) described above are described below with reference to a flow chart of FIG. 5. It is to be noted that X(t) in FIG. 5 is a standardized and non-correlated observation signal and corresponds to X'(t) of FIG. 4.

First at step S11, initial values are substituted into a separation matrix W. In order to satisfy the normal orthogonality restriction, also the initial values are a normal orthogonal matrix. Further, where a separation process is performed many times in the same environment, converged values in the preceding operation cycle may be used as the initial values in the present operation cycle. This can reduce the number of times of a loop process before convergence.

Then at step S12, it is decided whether or not W exhibits convergence. If W exhibits convergence, then the processing is ended, but if W does not exhibit convergence, then the processing advances to step S13.

Then at step S13, the separation signals Y at the point of time are calculated, and at step S14, $\Delta W$ is calculated in accordance with the expression (29) given hereinabove. Since this $\Delta W$ is calculated for each frequency bin, a loop process is repetitively performed while the expression (2) is applied to each value of w. After $\Delta W$ is determined, W is updated at step S15, whereafter the processing returns to step S12.

It is to be noted that, while, in the foregoing description, the steps S13 and S15 are provided on the outer sides of the frequency bin loop, the processes at the steps may be displaced to the inner side of the frequency bin loop such that $\Delta W$ is calculated for each frequency bin similarly as in the prior art. In this instance, the calculation expression of $\Delta W(\omega)$ and the updating expressions of $W(\omega)$ may be integrated such that $W(\omega)$ is calculated directly without calculating $\Delta W(\omega)$.

Further, while, in FIG. 5, the updating process of W is performed until W converges, the updating process of W may otherwise be repeated by a sufficiently great predetermined number of times.

Now, details of the rescaling process at step S5 (FIG. 4) described hereinabove are described. For the rescaling method, any one of the three methods described below may be used.

According to the first method of rescaling, a signal of the SIMO (Single Input Multiple Output) format is produced from results of separation (whose scales are not uniform). This method is expansion of a rescaling method for each frequency bin described in Noboru Murata and Shiro Ikeda, "An on-line algorithm for blind source separation on speed signals", Proceedings of 1998 International Symposium on Nonlinear Theory and its Applications (NOLTA '98), pp. 923-926, Crans-Montana, Switzerland, September 1998 (http://www.ism.ac./jp~shiro/papers/conferences/nolta1998.pdf) to scaling of the entire spectrograms using the separation matrix W of the expression (17) given hereinabove.

An element of the observation signal vector X(t) which originates from the kth sound source is represented by $X_{Yk}(t)$. $X_{Yk}(t)$ can be determined by assuming a state that only the kth sound source emits sound and applying a transfer function to the kth sound source. If results of separation of the independent component analysis are used, then the state that only the kth sound source emits sound can be represented by setting the elements of the vector of the expression (19) given hereinabove other than $Y_k(t)$ to zero, and the transfer function can be represented as an inverse matrix of the separation matrix W. Accordingly, $X_{Yk}(t)$ can be determined in accordance with the expression (58) given below. In the expression (58), Q is a matrix for the standardization and non-correlating of an observation signal. Further, the second term on the right side is the vector of the expression (19) given hereinabove in which the elements other that $Y_k(t)$ are set to zero. In $X_{Yk}(t)$ determined in this manner, the instability of the scale is eliminated.

$$X_{yk}(t) = (WQ)^{-1}\begin{bmatrix} 0 \\ Y_k(t) \\ 0 \end{bmatrix} \tag{58}$$

The second method of rescaling is based on the minimum distortion principle. This is expansion of the rescaling method for each frequency bin described in K. Matuoka and S. Nakashima, "Minimal distortion principle for blind source separation", Proceedings of International Conference on INDEPENDENT COMPONENT ANALYSIS and BLIND SIGNAL SEPARATION (ICA 2001), 2001, pp. 722-727 (http://ica2001.ucsd.edu/index_files/pdfs/099-matauoka.pdf) to rescaling of the entire spectrograms using the separation matrix W of the expression (17) given hereinabove.

In the rescaling based on the minimum distortion principle, the separation matrix W is re-calculated in accordance with the expression (59) given below. If the re-calculated separation matrix W is used to calculate separation signals in accordance with Y=WX again, then the instability of the scale disappears from Y.

$$W \leftarrow \mathrm{diag}((WQ)^{-1})WQ \tag{59}$$

The third method of rescaling utilizes independency of a separation signal and a residual signal as described below.

A signal $\alpha_k(\omega)Y_k(\omega, t)$ obtained by multiplying a separation result $Y_k(\omega, t)$ at the channel number k and the frequency bin number ω by a scaling coefficient $\alpha_k(\omega)$ and a residual $X_k(\omega, t)-\alpha_k(\omega)Y_k(\omega, t)$ of the separation result $Y_k(\omega, t)$ from the observation signal are assumed. If $\alpha_k(\omega)$ has a correct value, then the factor of $Y_k(\omega, t)$ must disappear completely from the residual $X_k(\omega, t)-\alpha_k(\omega)Y_k(\omega, t)$. Then, $\alpha_k(\omega)Y_k(\omega, t)$ at this time represents estimation of one of the original signals observed through the microphones including the scale.

Here, if the scale of independency is introduced, then that the element disappears completely can be represented as that $\{X_k(\omega, t)-\alpha_k(\omega)Y_k(\omega, t)\}$ and $\{Y_k(\omega, t)\}$ are independent of each other in the direction of time. This condition can be represented as given by the expression (60) below using arbitrary scalar functions f(•) and g(•). It is to be noted that an overlying line represents a conjugate complex number. Accordingly, the instability of the scale disappears if the scaling factor $\alpha_k(\omega)$ which satisfies the expression (60) given below is determined and $Y_k(\omega, t)$ is multiplied by the thus determined scaling factor $\alpha_k(\omega)$.

$$E_t[f(X_k(\omega,t)-\alpha_k(\omega)Y_k(\omega,t))\overline{g(Y_k(\omega,t))}]$$

$$-E_t[f(X_k(\omega,t)-\alpha_k(\omega)Y_k(\omega,t))]E_t[\overline{g(Y_k(\omega,t))}]=0 \tag{60}$$

If a case of f(x)=x is considered as a requirement of the expression (60) above, then the expression (61) is obtained as a condition which should be satisfied by the scaling factor $\alpha_k(\omega)$. g(x) of the expression (61) may be an arbitrary function, and, for example, any of the expressions (62) to (65) given below can be used as g(x). If $\alpha_k(\omega)Y_k(\omega, t)$ is used in place of $Y_k(\omega, t)$ as a separation result, then the instability of the scale is eliminated.

$$\alpha_k(\omega) = \frac{E_t[X_k(\omega, t)\overline{g(Y_k(\omega, t))}] - E_t[X_k(\omega, t)]E_t[\overline{g(Y_k(\omega, t))}]}{E_t[Y_k(\omega, t)\overline{g(Y_k(\omega, t))}] - E_t[Y_k(\omega, t)]E_t[\overline{g(Y_k(\omega, t))}]} \tag{61}$$

$$g(x) = x \tag{62}$$

$$g(x) = \sqrt{x} \tag{63}$$

$$g(x) = x^{2/3} \tag{64}$$

$$g(x) = \tanh(|x|)\frac{x}{|x|} \tag{65}$$

Figure 6A:
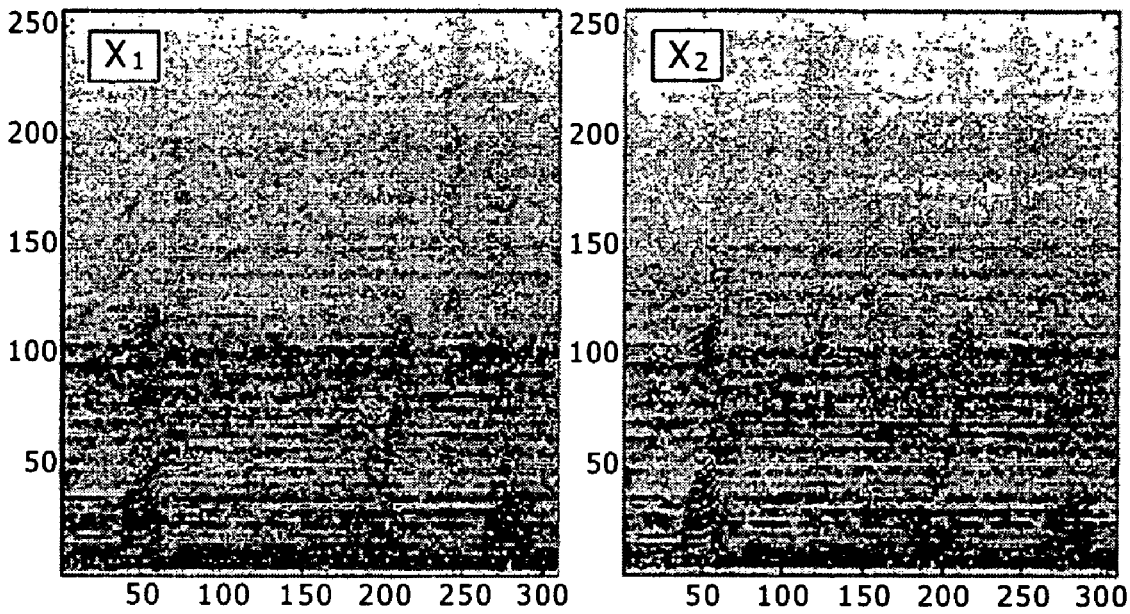
FIGS. 6A and 6B are views illustrating an observation signal and a separation signal where a signal separation process is performed over entire spectrograms.
Figure 6B:
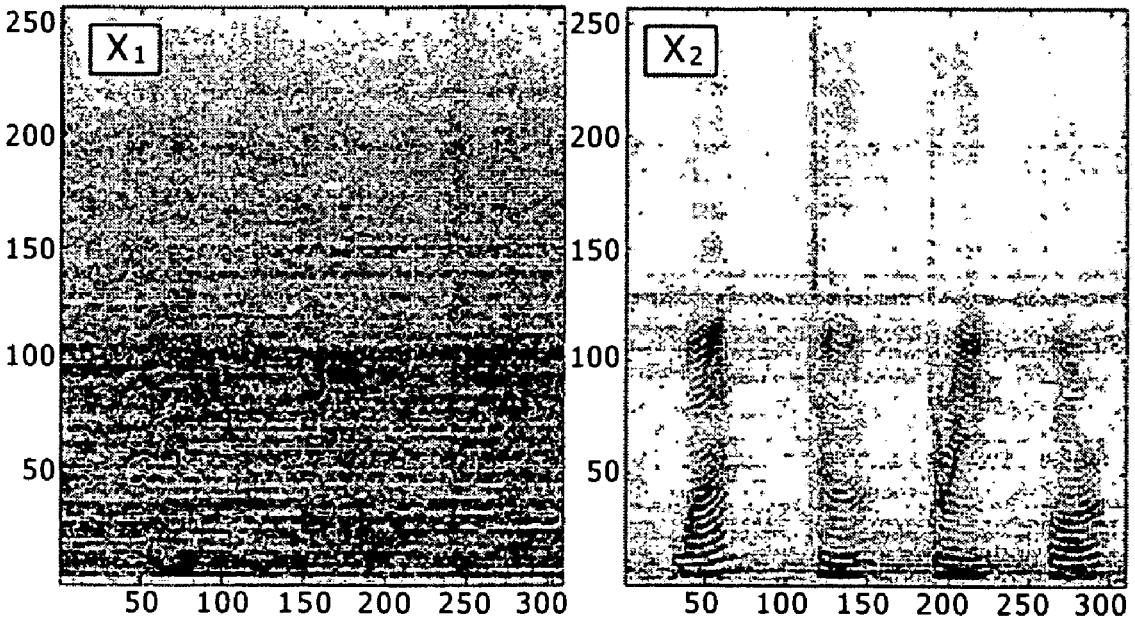
Figure 7:
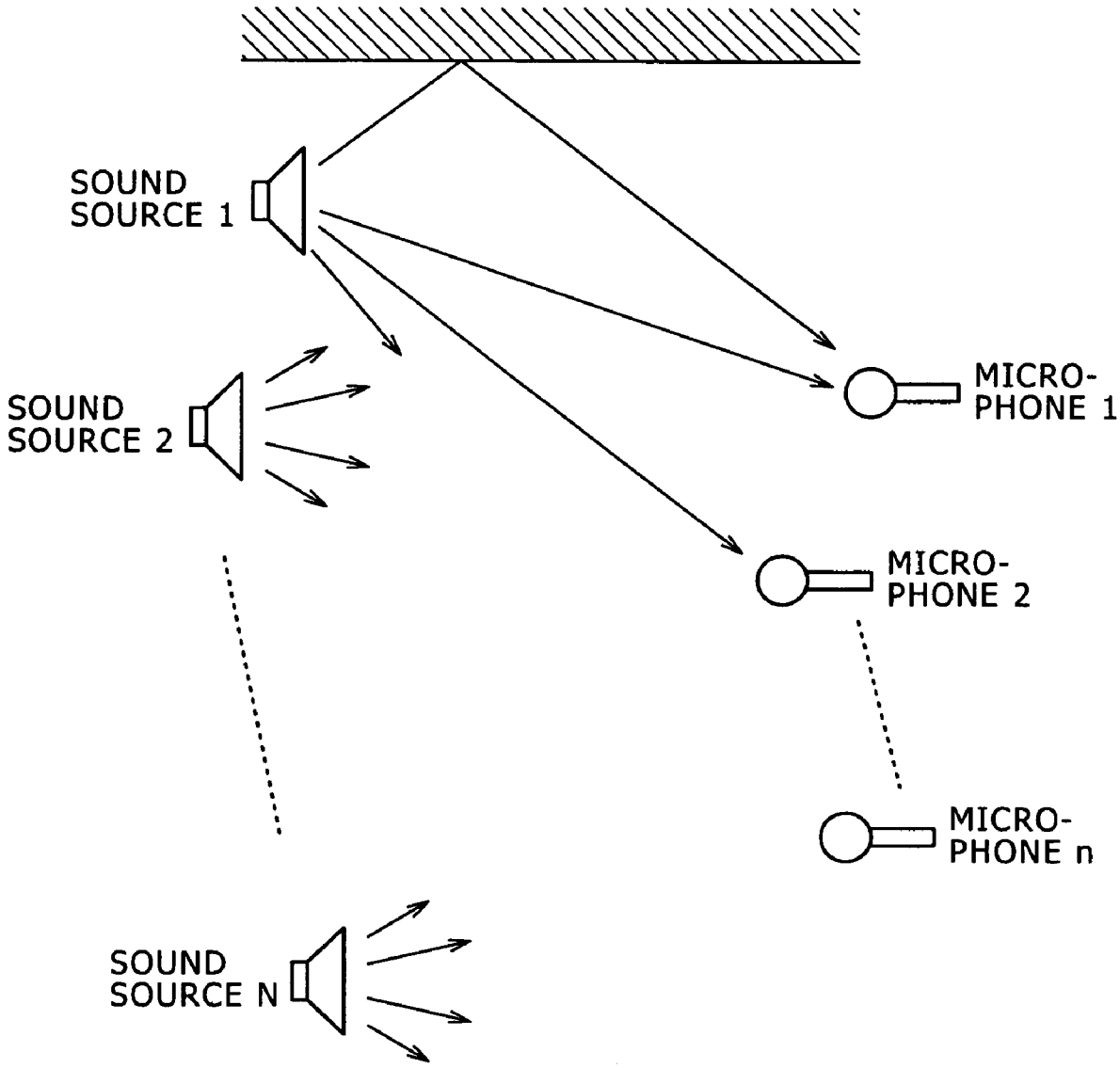
FIG. 7 is a schematic view illustrating a situation wherein original signals outputted from N sound sources are observed using n microphones.
Figure 8:
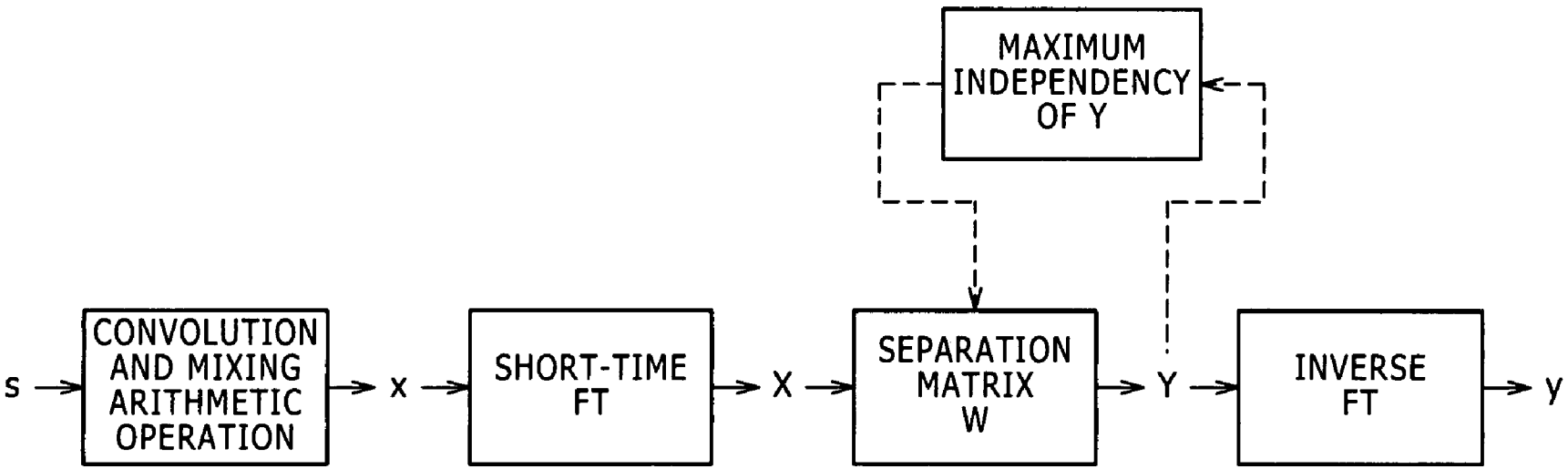
FIG. 8 is a flow diagram illustrating an outline of conventional independent component analysis in the time-frequency domain.
Figures 9A, 9B, 9C, 9D:
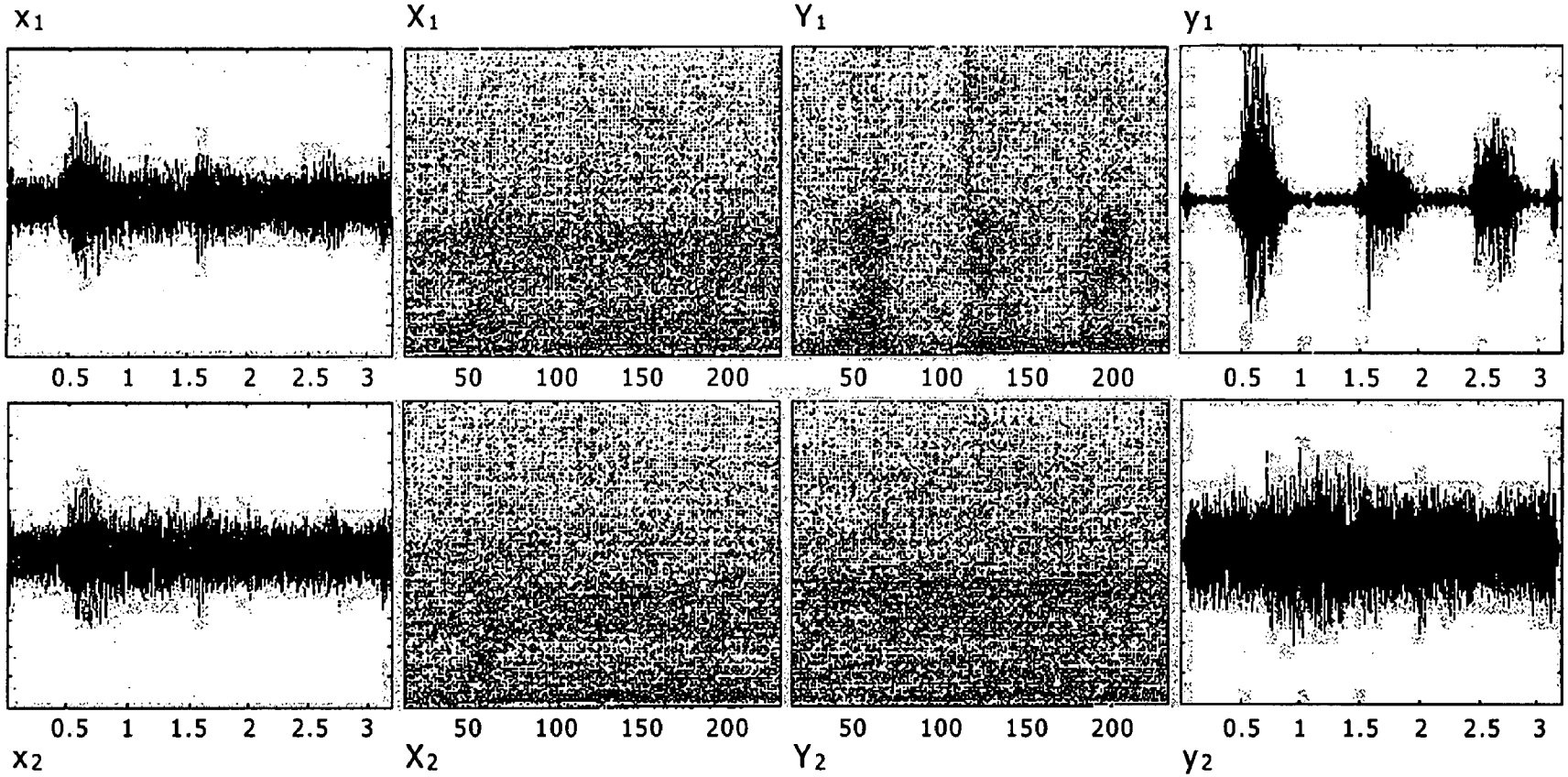
FIGS. 9A to 9D are observation signals and spectrograms of the observation signals and separation signals and spectrograms of the separation signals.
Figure 10:
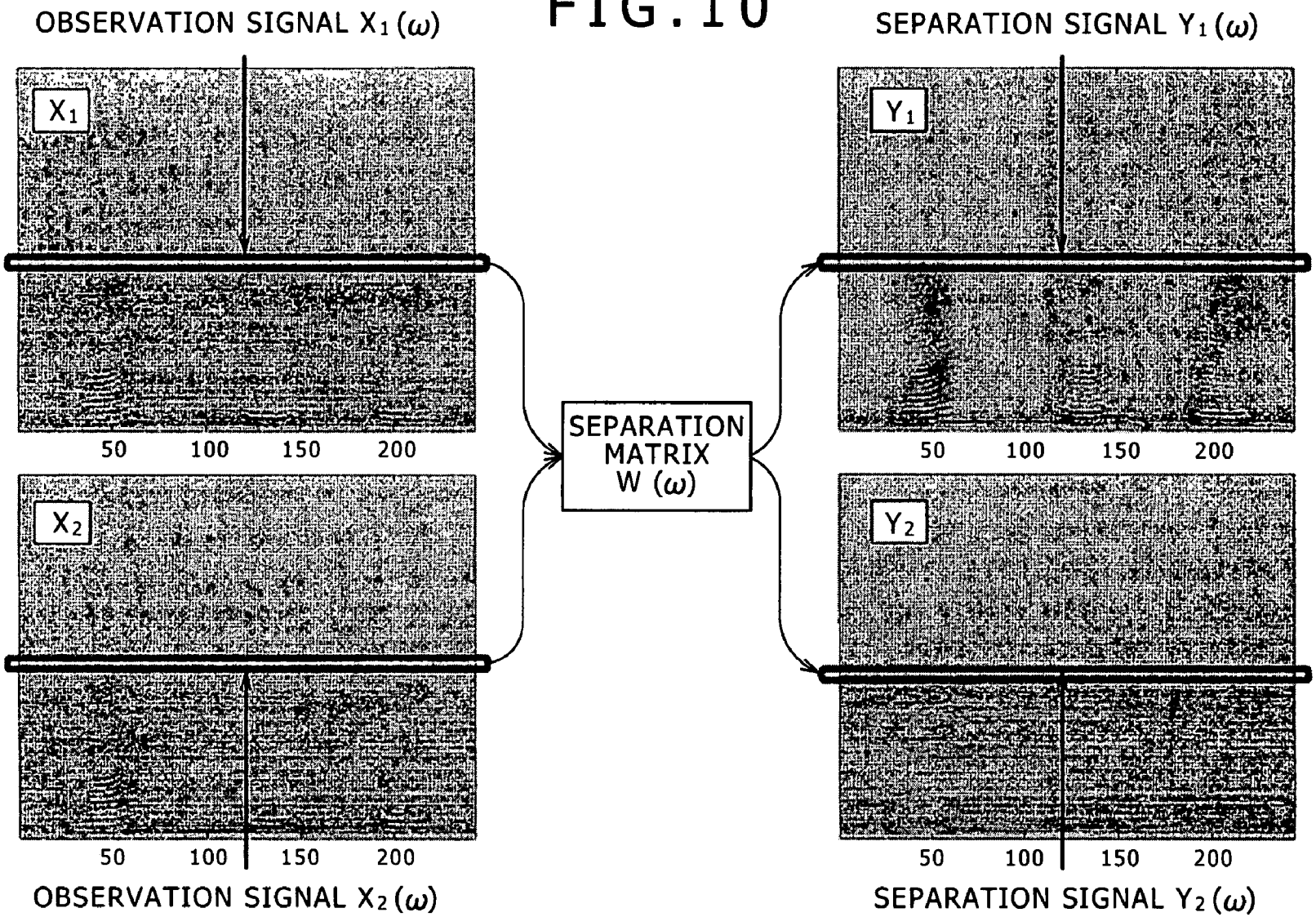
FIG. 10 is a view illustrating a manner in which a signal separation process is executed for each frequency bin.
Figure 11:
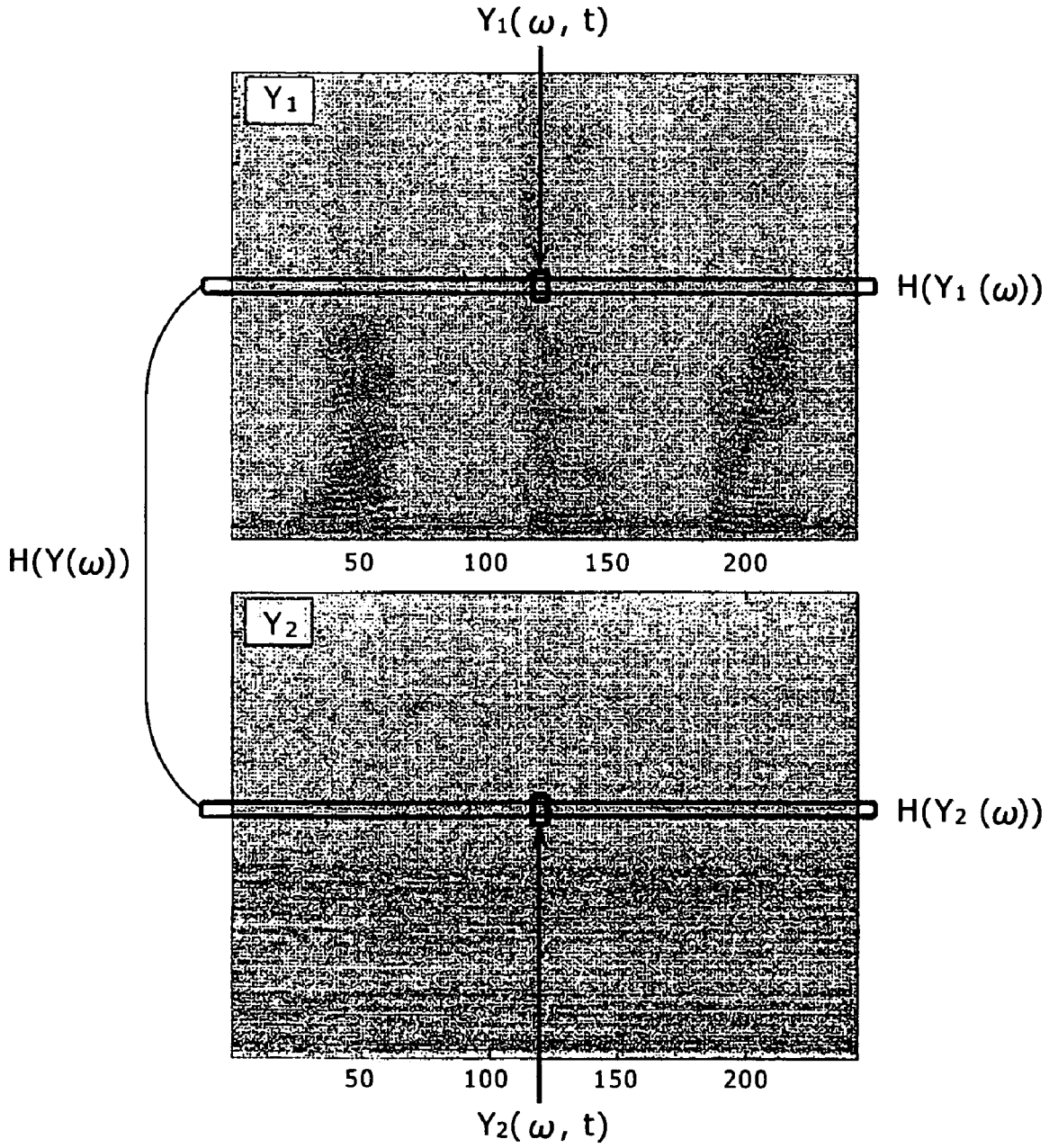
FIG. 11 is a view illustrating conventional entropy and simultaneous entropy.
Figure 12A:
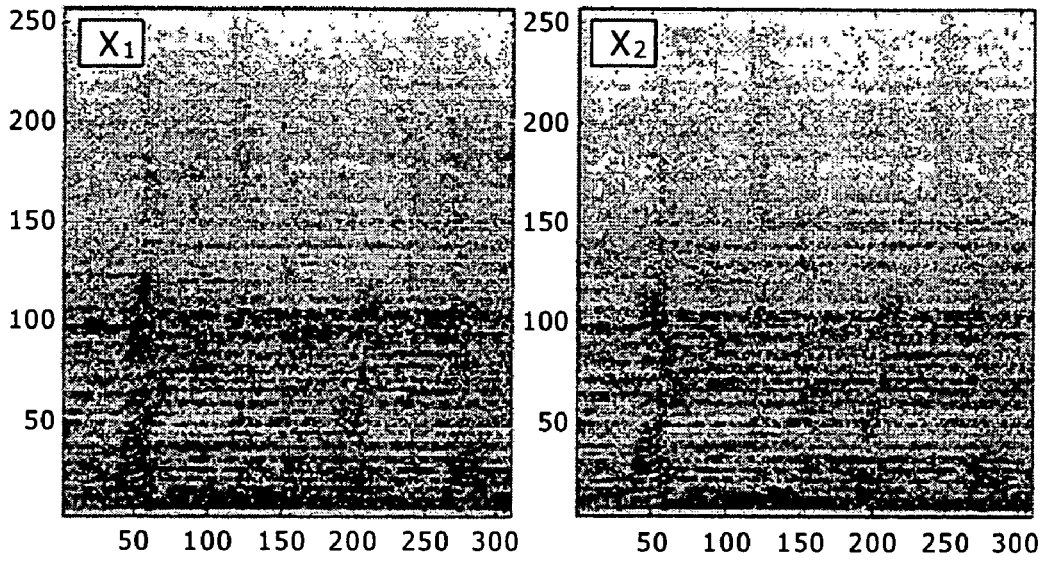
FIGS. 12A and 12B are views illustrating an example of observation signals and separation signals where a conventional signal separation process is performed for each frequency bin.
Figure 12B:
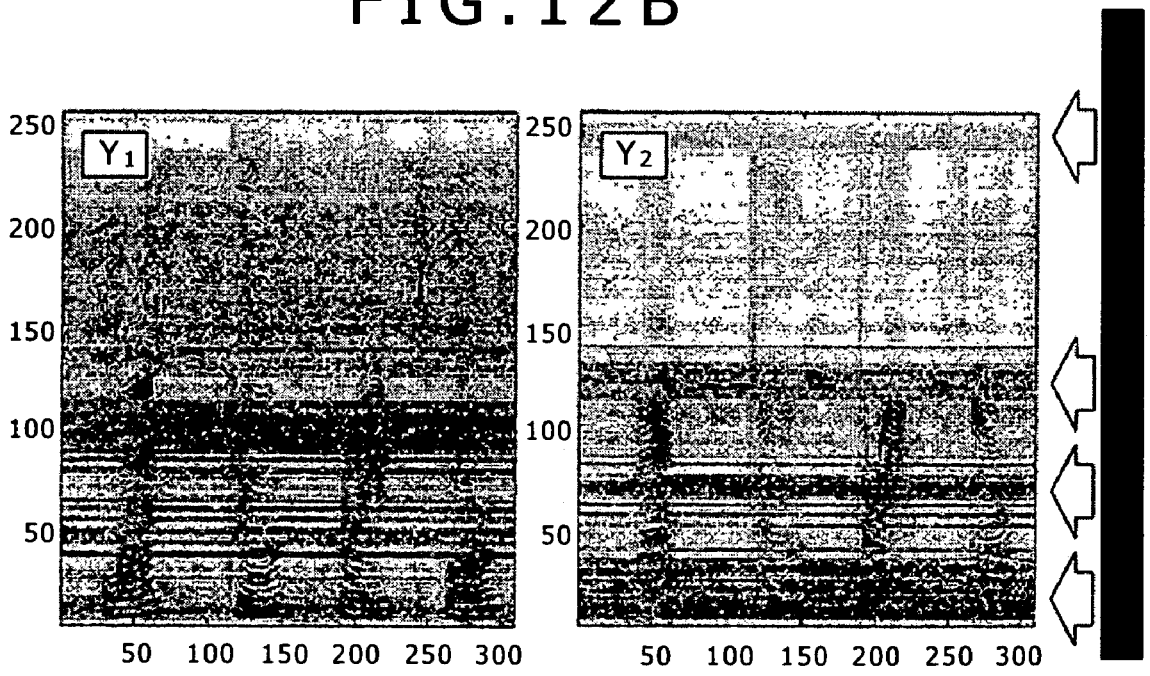

In the following, particular separation results are described. FIG. 6A illustrates spectrograms produced from the two files of "rsm2_mA.wav" and "rsm2_mB.wav" mentioned hereinabove and represents an example of an observation signal wherein speech and music are mixed with each other. Meanwhile, FIG. 6B illustrates results where the two spectrograms of FIG. 6A are used as an observation signal and the updating expression given as the expression (29) above and the score function of the expression (37) given hereinabove are used to perform separation. The other conditions are similar to those described hereinabove with reference to FIG. 12. As can be seen from FIG. 6B, while permutation occurs where the conventional method is used (FIG. 12B), no permutation occurs where the separation method according to the present embodiment is used.

As described in detail above, with the speech signal separation apparatus 1 according to the present embodiment, in place of separation of signals for individual frequency bins using the separation matrix W(ω) as in the prior art, the separation matrix W is used to separate signals over the entire spectrograms. Consequently, the problem of permutation can be eliminated without performing a post-process after the separation. Particularly with the speech signal separation apparatus 1 of the present embodiment, since a gradient method with the normal orthogonality restriction is used, the separation matrix W can be determined through a reduced number of times of execution of a loop process when compared with that in an alternative case wherein no normal orthogonality restriction is provided.

It is to be noted that the present invention is not limited to the embodiment described hereinabove, but various medications and alterations can be made without departing from the spirit and scope of the present invention.

For example, while, in the embodiment described above, the learning coefficient n in the expression (25) given hereinabove is a constant, the value of the learning coefficient q may otherwise be varied adaptively depending upon the value of ΔW. In particular, where the absolute values of the elements of ΔW are high, η may be set to a low value to prevent an overflow of W, but where ΔW is proximate to a zero matrix (where W approaches converging points), η may be set to a high value to accelerate convergence to the converging points.

In the following, a calculation method of η where the value of the learning coefficient η is varied adaptively in this manner is described.

$\|\Delta W\|_N$ is calculated as a norm of a matrix ΔW, for example, in accordance with the expression (68) given below. The learning coefficient η is represented as a function of $\|\Delta W\|_N$ as seen from the expression (66) given below. Or, a norm $\|\Delta W\|_N$ is calculated similarly also with regard to W in addition to ΔW, and a ratio between them, that is, $\|\Delta W\|_N/\|W\|_N$, is determined as an argument of f(•) as given by the expression (67) below. As a simple example, N=2 can be used. For f(•) of the expressions (66) and (67), for example, a monotonically decreasing function which satisfies f(0)=η0 and f(∞)→0 is used as in the expressions (69) to (71) given below. In the expressions (69) to (71), a is an arbitrary positive value and is a parameter for adjusting the degree of decrease of f(•). Meanwhile, L is an arbitrary positive real number. As a simple example, a=1 and L=2 can be used.

$$\eta = f(\|\Delta W\|_N) \tag{66}$$

$$\eta = f(\|\Delta W\|_N / \|W\|_N) \tag{67}$$

where $$\|\Delta W\|_N = \left\{ \sum_{\omega=1}^{M} \sum_{j=1}^{n} \sum_{i=1}^{n} |w_{ij}(\omega)|^N \right\}^{\frac{1}{N}} \tag{68}$$

$$f(x) = \frac{\eta_0}{ax^L + 1} \tag{69}$$

$$f(x) = \frac{\eta_0}{\cosh(ax^L)} \tag{70}$$

$$f(x) = \eta_0 \exp(-|ax^L|) \tag{71}$$

It is to be noted that, while, in the expressions (66) and (67), a learning coefficient η common to all frequency bins is used, different learning coefficients η may be used for the individual frequency bins as seen from the expression (72) given below. In this instance, the norm $\|\Delta W(\omega)\|_N$ of ΔW(ω) is calculated, for example, in accordance with the expression (74) given below, and the learning coefficient η(ω) is represented as a function of $\|\Delta W(\omega)\|_N$ as seen from the expression (73) given below. In the expression (73), f(•) is similar to that in the expressions (66) and (67). Further, $\|\Delta W(\omega)\|_N / \|W(\omega)\|_N$ may be used in place of $\|\Delta W(\omega)\|_N$.

$$W(\omega) \leftarrow W(\omega) + \eta(\omega) \cdot \Delta W(\omega) \tag{72}$$

$$\eta(\omega) = f(\|\Delta W(\omega)\|_N) \tag{73}$$

$$\|\Delta W(\omega)\|_N = \left\{ \sum_{j=1}^{n} \sum_{i=1}^{n} |w_{ij}(\omega)|^N \right\}^{\frac{1}{N}} \tag{74}$$

Further, in the embodiment described above, signals of the entire spectrograms, that is, signals of all frequency bins of the spectrograms, are used. However, a frequency bin in which little signals exist over all channels (only components proximate to zero exist) has little influence on separation signals in the time domain irrespective of whether the separation results in success or in failure. Therefore, if such frequency bins are removed to degenerate the spectrograms, then the calculation amount can be reduced and the speed of the separation can be raised.

As a method of degenerating a spectrogram, the following example is available. In particular, after spectrograms of an observation signal are produced, it is decided whether or not the absolute value of the signal is higher than a predetermined threshold value for each frequency bin. Then, a frequency bin in which the signal is lower than the threshold value in all frames and in all channels is decided as a frequency in which no signal exists, and the frequency bin is removed from the spectrograms. However, in order to allow later reconstruction, it is recorded what numbered frequency bin is removed. If it is assumed that no signal exists in m frequency bins, then the spectrograms after the removal have M−m frequency bins.

As another example of degenerating spectrograms, a method of calculating the intensity D(ω) of a signal, for example, in accordance with the expression (75) given below for each frequency bin and adopting M−m frequency bins which exhibit comparatively high signal intensities (removing m frequency bins which exhibit comparatively low signal intensities) is available.

$$D(\omega) = \sum_{k=1}^{n} \sum_{t=1}^{T} |Y_k(\omega, t)|^2 \tag{75}$$

After the spectrograms are degenerated, standardization and non-correlating, separation and rescaling processes are performed for the degenerated spectrograms. Further, those frequency bins removed formerly are inserted back. It is to be noted that a vector whose elements are all equal to zero may be inserted in place of the removed signals. If the resulting signals are inverse Fourier transformed, then separation signals in the time domain can be obtained.

Further, while, in the embodiment described hereinabove, the number of microphones and the number of sound sources are equal to each other, the present invention can be applied also to another case wherein the number of microphones is greater than the number of sound sources. In this instance, the number of microphones can be reduced down to the number of sound sources, for example, if principal component analysis (PCA) is used.

Further, while, in the embodiment described hereinabove, sound is reproduced through a speaker, it is otherwise possible to output separation signals so as to be used for speech recognition and so forth. In this instance, the inverse Fourier transform process may be omitted suitably. Where separation signals are used for speech recognition, it is necessary to specify which one of a plurality of separation signals represents speech. To this end, for example, one of methods described below may be used.

(a) For each of a plurality of separation signals, one channel which is most "likely to speech" is specified using the kurtosis or the like, and the separation signal is used for speech recognition.

(b) A plurality of separation signals are inputted in parallel to a plurality of speech recognition apparatus so that speech recognition is performed by the speech recognition apparatus. Then, the scale such as the likelihood or the reliability is calculated for each recognition result, and that one of the recognition results which exhibits the highest scale is adopted.

While a preferred embodiment of the present invention has been described using specific terms, such description is for illustrative purpose only, and it is to be understood that changes and variations may be set without departing from the spirit or scope of the following claims.

What is claimed is:

1. A speech signal separation apparatus for separating an observation signal in a time domain of a plurality of channels wherein a plurality of signals including a speech signal are mixed using independent component analysis to produce a plurality of separation signals of the different channels, comprising:

a first conversion section configured to convert the observation signal in the time domain into an observation signal in a time-frequency domain;

a non-correlating section configured to non-correlate the observation signal in the time-frequency domain between the channels;

a separation section configured to produce separation signals in the time-frequency domain from the observation signal in the time-frequency domain; and a second conversion section configured to convert the separation signals in the time-frequency domain into separation signals in the time domain;

said separation section being operable to produce the separation signals in the time-frequency domain from the observation signal in the time-frequency domain and a separation matrix in which initial values are substituted, calculate modification values for the separation matrix using the separation signals in the time-frequency domain, a score function which uses a multi-dimensional probability density function, and the separation matrix, modify the separation matrix until the separation matrix substantially converges using the modification values and produce separation signals in the time-frequency domain using the substantially converged separation matrix;

each of the separation matrix which includes the initial values and the separation matrix after the modification which includes the modification values being a normal orthogonal matrix.

2. The speech signal separation apparatus according to claim 1, wherein the score function returns a dimensionless amount as a return value thereof which has a phase which relies upon only one argument.

3. A speech signal separation method for separating an observation signal in a time domain of a plurality of channels wherein a plurality of signals including a speech signal are mixed using independent component analysis to produce a plurality of separation signals of the different channels, comprising the steps of:

converting the observation signal in the time domain into an observation signal in a time-frequency domain;

non-correlating the observation signal in the time-frequency domain between the channels;

producing separation signals in the time-frequency domain from the observation signal in the time-frequency domain and a separation matrix in which initial values are substituted;

calculating modification values for the separation matrix using the separation signals in the time-frequency domain, a score function which uses a multi-dimensional probability density function, and the separation matrix;

modifying the separation matrix using the modification values until the separation matrix substantially converges; and converting the separation signals in the time-frequency domain produced using the substantially converged separation matrix into separation signals in the time domain;

each of the separation matrix which includes the initial values and the separation matrix after the modification which includes the modification values being a normal orthogonal matrix.

4. The speech signal separation method according to claim 3, wherein the score function returns a dimensionless amount as a return value thereof which has a phase which relies upon only one argument.

* * * * *